US007377511B2

(12) United States Patent
Watanabe et al.

(10) Patent No.: US 7,377,511 B2
(45) Date of Patent: May 27, 2008

(54) SHEET STACKING APPARATUS

(75) Inventors: Naoto Watanabe, Chiba (JP); Yoshinori Isobe, Ibaraki (JP); Masahiro Yonenuma, Chiba (JP); Tetsuya Terada, Ibaraki (JP)

(73) Assignees: Canon Kabushiki Kaisha, Tokyo (JP); Canon Finetech Inc., Ibaraki-Ken (JP)

( * ) Notice: Subject to any disclaimer, the term of this patent is extended or adjusted under 35 U.S.C. 154(b) by 16 days.

(21) Appl. No.: 11/452,950

(22) Filed: Jun. 15, 2006

(65) Prior Publication Data

US 2006/0232002 A1 Oct. 19, 2006

Related U.S. Application Data

(62) Division of application No. 10/791,820, filed on Mar. 4, 2004.

(30) Foreign Application Priority Data

Mar. 7, 2003 (JP) ..... 2003-062216
Sep. 1, 2003 (JP) ..... 2003-308884

(51) Int. Cl.
*B65H 39/10* (2006.01)

(52) U.S. Cl. ..... 271/292; 271/294; 271/298

(58) Field of Classification Search ..... 271/294, 271/292, 298
See application file for complete search history.

(56) References Cited

U.S. PATENT DOCUMENTS 5,351,112 A 9/1994 Naito et al. ..... 355/233
5,579,083 A 11/1996 Naito et al. ..... 355/50
5,715,506 A 2/1998 Takeuchi et al. ..... 399/303
5,819,151 A 10/1998 Naito et al. ..... 399/367
6,146,085 A 11/2000 Namba et al. ..... 414/789.9
6,231,045 B1 5/2001 Yamada et al. ..... 271/292
6,315,288 B1 11/2001 Sugishima et al. ..... 271/303
6,322,070 B2 11/2001 Yamada et al. ..... 271/293
6,398,214 B1 6/2002 Moteki et al. ..... 271/220
6,471,429 B1 10/2002 Isobe et al. ..... 400/582
6,494,453 B1 12/2002 Yamada et al. ..... 271/288
6,631,986 B2 10/2003 Silverbrook ..... 347/103

FOREIGN PATENT DOCUMENTS

JP 2000-53308 2/2000
JP 2003-48661 2/2003

*Primary Examiner*—David H Bollinger
(74) *Attorney, Agent, or Firm*—Fitzpatrick, Cella, Harper & Scinto

(57) ABSTRACT

A sheet stacking apparatus including a first tray on which sheets discharged form an outlet are stacked, the first tray being movable between a stacking position at which sheets discharged from an outlet are stacked and a first retracted position above the staking position; a second tray on which sheets discharged from an outlet are stacked, the first tray being disposed below the first tray and being movable independently of the first tray, the second tray being movable between the stacking position and a second retracted position below the stacking position; and a controller that causes the second tray to descend when the sheets are to be stacked on the first tray, the controller causing the second tray to stop descending when the second tray reaches a standby position where a distance between the outlet and a top surface of the sheets stacked on the second tray is a predetermined distance.

4 Claims, 19 Drawing Sheets

| FIG. 9A | FIG. 9B |
|---|---|

SHEET STACKING APPARATUS

This application is a divisional of U.S. patent application Ser. No. 10/791,820, filed Mar. 4, 2004.

BACKGROUND OF THE INVENTION

1. Field of the Invention

The present invention relates to a sheet stacking apparatus for stacking on stack trays sheets with images formed thereon.

2. Related Background Art

A sheet post-handling apparatus has been widely used in which images are formed (or printed) on sheets by an image forming apparatus such as a copier and a printer; then, the sheets are stacked one over the other, sorted, and bound; then the printed sheets and bound sheets are stacked on a plurality of stack trays. With this type of conventional sheet post-handling apparatus, when a sheet surface sensor detects the position of a paper-surface in the lower tray by turn-off thereof the lower tray is caused to stop. The position at which the lower tray stops is a standby position. The above-mentioned configuration is disclosed in, for example, Japanese Patent Application Laid-Open No. 2000-53308 and Japanese Patent Application Laid-Open No. 2003-48661.

However, with the above-mentioned conventional sheet post-handling apparatus, friction between the walls of the stack tray and side edges of the sheets may cause the sheets to lean against the stacker walls. Also, the side edges of the sheets may be caught by a sensor flag projecting from the stacker wall and cause the sensor flag to remain ON, so that the lower tray descends much lower than a right sheet position. If the descending lower tray is forcibly caused to stop at the right sheet position, the sheets that are leaning against the stacker walls and/or are being caught by the sensor may drop from the tray due to vibration and reaction that occur upon stoppage of the tray.

Also, when chattering occur during a sheet-surface sensor generating OFF-output, or when the user places a stack of sheets on the tray during the tray descending, the tray is stopped at a position much lower than the right position. Further, when the user forcibly sets the sheet surface sensor to an ON-output, the tray continues to descend by a time length during which the sensor is ON.

With the aforementioned conventional method, the descending movement of a tray is stopped upon the OFF output of the sensor detector, requiring a longer time than necessary before the tray takes up a standby position.

SUMMARY OF THE INVENTION

In accordance with one aspect of the invention there is provided a sheet stacking apparatus comprising a first tray on which sheets discharged from an outlet are stacked, said first tray being movable between a stacking position at which the sheets discharged from the outlet are stacked and a first retracted position above the outlet; a second tray on which the sheets discharged from the outlet are stacked, said second tray being disposed below said first tray and being movable independently of said first tray, said second tray being movable between the stacking position and a second retracted position below the stacking position; drive devices which respectively drive said first tray and said second tray to ascend and descend; a sheet surface detecting device which detects a top surface of said first or second tray at the stacking position, or a top surface of the sheets stacked on said first or second tray at the stacking position; height controlling means which controls the drive device to move said first or second tray to the stacking position in such a way that the top surface detected by said sheet surface detecting device is below the outlet; and a controller which causes said second tray to descend a predetermined distance from the stacking position regardless of a thickness of the sheets stacked on said second tray when the sheet is to be stacked on said first tray, said controller causing the top surface of said second tray or the top surface of the sheets stacked on said second tray to descend to a position where movement of said first tray to the stacking position is not interfered with.

In accordance with another aspect of the invention there is a sheet stacking apparatus, comprising a plurality of stack trays disposed vertically onto which sheets discharged from an outlet are stacked, said apparatus comprising a plurality of driving means which drive respective stack trays to ascend and descend; a sheet surface detecting device which detects a top surface of the stack tray, a top surface of the sheets stacked on the stack tray at a stacking position at which the sheets discharged from the outlet are stacked; height controlling means which controls said driving means to move the stack tray to the stacking position in such a way that the top surface detected by said sheet surface detecting device is below the outlet; movement distance detecting means which detects a predetermined distance of movement of the stack tray, so as to cause the top surface of the stack tray or the top surface of the sheets stacked on the stack tray to descend to a position where movement of another stack tray to the stacking position is not interfered with, when said another stack tray moves from above so that the top surface may be detected by said sheet surface detecting device; and standby controlling means which causes the stack tray to stop when said movement distance detecting means detects that the stack tray has moved the predetermined distance.

In accordance with yet another aspect of the invention, there is a sheet stacking apparatus, comprising a plurality of stack trays disposed vertically onto which sheets discharged from an outlet are stacked, said apparatus comprising a plurality of driving means which drive respective stack trays to ascend and descend; a sheet surface detecting device which detects a top surface of the stack tray, a top surface of the sheets stacked on the stack tray at a stacking position at which the sheets discharged from the outlet are stacked; height controlling means which controls said driving means to move the stack tray to the stacking position in such a way that the top surface detected by said sheet surface detecting device is below the outlet; time measuring means which measures time; standby controlling means which causes the stack tray to stop when said time measuring means detects the elapse, from a start of movement, of a time period for moving operation that is calculated based on a predetermined distance of movement of the stack tray and a moving speed where the stack tray moves the predetermined distance, so as to cause the top surface of the stack tray or the top surface of the sheets stacked on the stack tray to descend to a position where movement of another stack tray to the stacking position is not interfered with, when said another stack tray moves from above so that the top surface may be detected by said sheet surface detecting device.

In accordance with still yet another aspect of the invention, an image forming apparatus, comprising an image forming unit which forms an image on a sheet; and a sheet stacking apparatus, the sheet stacking apparatus comprising a first tray on which sheets discharged from an outlet are stacked, said first tray being movable between a stacking position at which the sheets discharged from the outlet are stacked and a first retracted position above the outlet; a second tray on which the sheets discharged from the outlet are stacked, said second tray being disposed below said first tray and being movable independently of said first tray, said second tray being movable between the stacking position and a second retracted position below the stacking position;

drive devices which respectively drive said first tray and said second tray to ascend and descend; a sheet surface detecting device which detects a top surface of said first or second tray at the stacking position, or a top surface of the sheets stacked on said first or second tray at the stacking position; height controlling means which controls the drive device to move said first or second tray to the stacking position in such a way that the top surface detected by said sheet surface detecting device is below the outlet; and a controller which causes said second tray to descend a predetermined distance from the stacking position regardless of a thickness of the sheets stacked on said second tray when the sheet is to be stacked on said first tray, said controller causing the top surface of said second tray or the top surface of the sheets stacked on said second tray to descend to a position where movement of said first tray to the stacking position is not interfered with.

In yet another aspect of the present invention, there is an image forming apparatus, comprising an image forming unit which forms an image on a sheet; and a sheet stacking apparatus, the sheet stacking apparatus comprising a plurality of stack trays disposed vertically onto which sheets discharged from an outlet are stacked, said apparatus comprising: a plurality of driving means which drive respective stack trays to ascend and descend; a sheet surface detecting device which detects a top surface of the stack tray, a top surface of the sheets stacked on the stack tray at a stacking position at which the sheets discharged from the outlet are stacked; height controlling means which controls said driving means to move the stack tray to the stacking position in such a way that the top surface detected by said sheet surface detecting device is below the outlet; movement distance detecting means which detects a predetermined distance of movement of the stack tray, so as to cause the top surface of the stack tray or the top surface of the sheets stacked on the stack tray to descend to a position where movement of another stack tray to the stacking position is not interfered with, when said another stack tray moves from above so that the top surface may be detected by said sheet surface detecting device; and standby controlling means which causes the stack tray to stop when said movement distance detecting means detects that the stack tray has moved the predetermined distance.

And in still another aspect of the present invention there is an image forming apparatus, comprising an image forming unit which forms an image on a sheet; and a sheet stacking apparatus, the sheet stacking apparatus comprising: a plurality of stack trays disposed vertically onto which sheets discharged from an outlet are stacked, said apparatus comprising: a plurality of driving means which drive respective stack trays to ascend and descend; a sheet surface detecting device which detects a top surface of the stack tray, a top surface of the sheets stacked on the stack tray at a stacking position at which the sheets discharged from the outlet are stacked; height controlling means which controls said driving means to move the stack tray to the stacking position in such a way that the top surface detected by said sheet surface detecting device is below the outlet; and time measuring means which measures time; standby controlling means which causes the stack tray to stop when said time measuring means detects the elapse, from a start of movement, of a time period for moving operation that is calculated based on a predetermined distance of movement of the stack tray and a moving speed where the stack tray moves the predetermined distance, so as to cause the top surface of the stack tray or the top surface of the sheets stacked on the stack tray to descend to a position where movement of another stack tray to the stacking position is not interfered with, when said another stack tray moves from above so that the top surface may be detected by said sheet surface detecting device.

DESCRIPTION OF THE PREFERRED EMBODIMENTS

Figure 1:
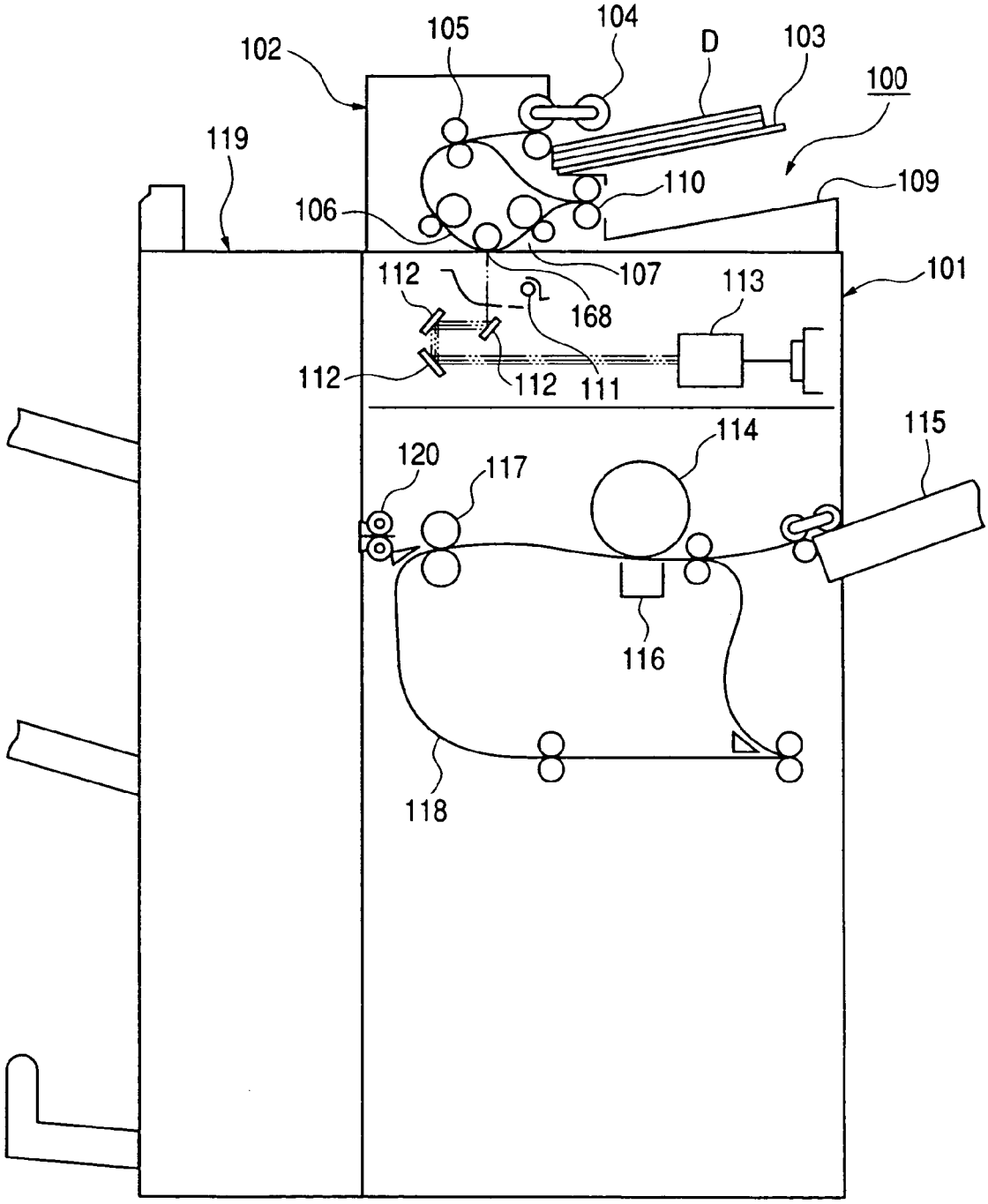
FIG. 1 illustrates a general configuration of an image forming apparatus according to the present invention.

FIG. 1 illustrates a configuration of an image forming apparatus according to the present invention, the image forming apparatus incorporating a sheet post-handling apparatus. FIG. 1 shows a general configuration of an exemplary electrophotographic copying machine.

Referring to FIG. 1, reference numeral 100 denotes a copying machine. The copying machine 100 includes a main unit 101 and a finisher 119 that serves as a sheet post-handling apparatus. An original feeding apparatus 102 is located at an upper portion of the main unit 101.

A user places an original D on an original setting section 103 and a feeding section 104 feeds the original to a registration roller pair 105 on a page-by-page basis. Then, the registration roller pair 105 blocks the original D temporarily to produce a loop in the original D, thereby removing skew in the original D. Subsequently, the original D advances along an inlet path 106 to pass through a reading position 108 where an image on the surface of the original D is read. The original D which has passed through a reading position then advances along a discharge path 107 and is discharged onto a discharge tray 109.

When images on both surfaces of the original D are read, the original D is first passes through the reading position 108 so that an image on one of the surfaces is read. Then, the original D passes through the discharge path 107 and takes a switchback course with the aid of an inversion roller pair 110, so that both surfaces of the original D are inverted each other and then advanced to the registration roller pair 105. Just as when the image was read from the one surface of the original D, the registration roller pair 105 blocks the original D to remove the skew in the original D. Then, the original D advances along the inlet path 106 and an image on the other surface of the original is read at the reading position 108. Thereafter, the original D passes through the discharge path 107 to the discharge tray 109.

When the original that passes through the reading position 108, the original is exposed to light from an illumination section 111 and the light reflected by the original is directed by a mirror 112 to an optical element 113 (CCD or the like) that in turn converts the light into image data. Then, the laser light illuminates a photoconductive drum 114 in accordance with the image data, thereby forming a latent image on the photoconductive drum 114. The latent image formed on the photoconductive drum 114 is developed with toner supplied from a toner supplying apparatus, not shown, thereby forming a toner image on the photosensitive drum.

While the toner image is being formed, a sheet in the form of, for example, print paper or a plastic film stacked on a cassette 115 is fed from the cassette 115 in accordance with a recording signal. The sheet enters between the photoconductive drum 114 and the transfer unit 116. The toner image on the photoconductive drum 114 is transferred by a transfer unit 116 onto the sheet. When the sheet passes through a fixing unit 117, the toner image is heated and pressed to be fixed.

When images are formed on both surfaces of the sheet, an image is first fixed on a front surface of the sheet and then the sheet passes along a path 118 located downstream of the fixing unit 117 and advances between the photoconductive drum 114 and transfer unit 116 again, so that another image is transferred onto the back surface of the sheet. The toner image on the back surface of the sheet is fixed in the fixing unit 117 and the sheet is discharged to the external finisher 119.

Figure 2:
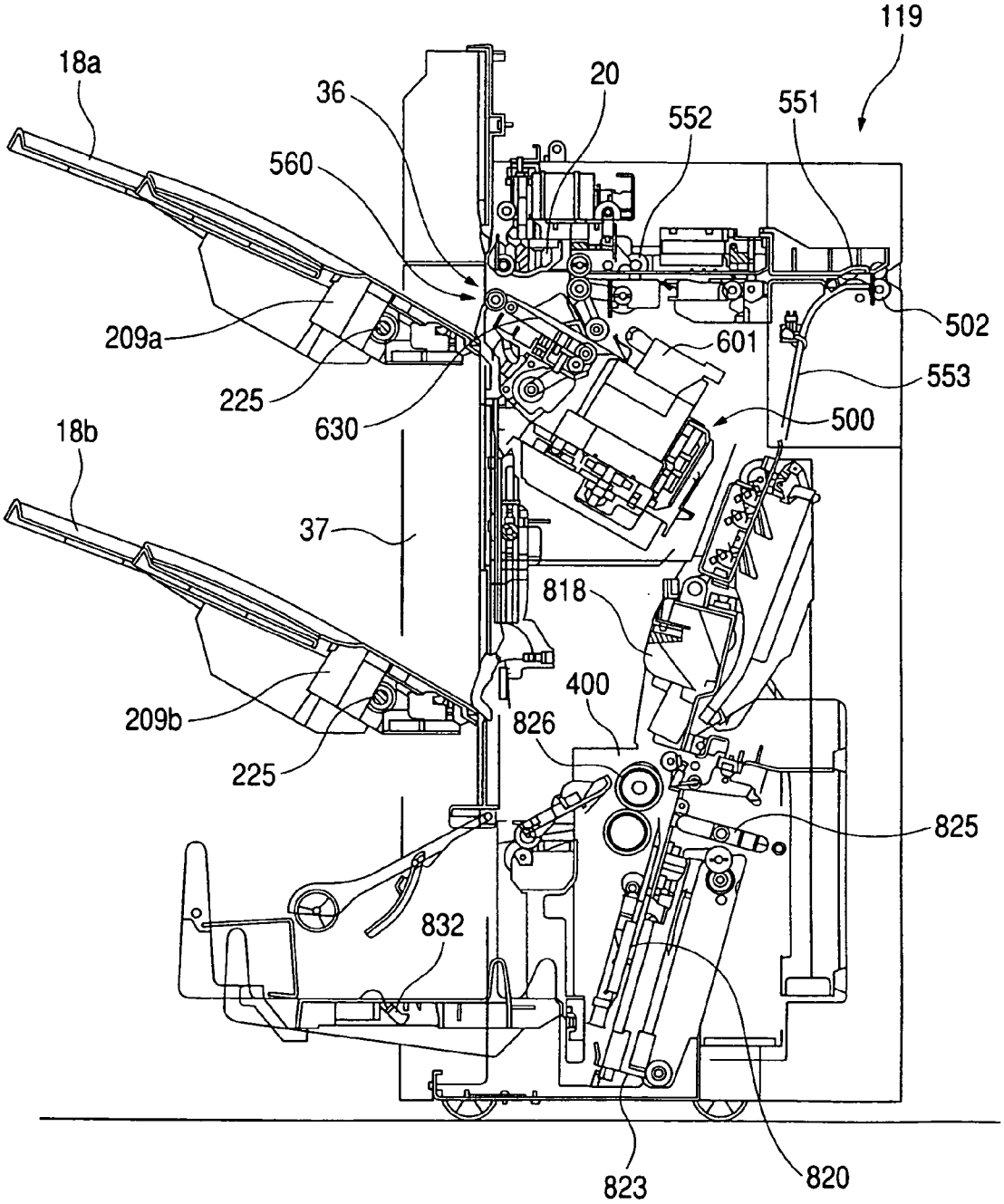
FIG. 2 illustrates a general configuration of a sheet post-handling apparatus according to an embodiment.

The finisher 119 receives the sheets discharged from the main unit 101 in order and performs various post-printing operations: an operation in which a plurality of sheets are aligned and tied in a bundle, a stapling operation in which the sheets in a bundle are stapled, a punching operation in which the sheets received are punched through near the trailing ends of the sheets, a sorting operation, a non-sorting operation, and a binding operation. As shown in FIG. 2, the finisher 119 includes primarily a folding unit 400 and a processing unit 500.

Referring to FIG. 2, the processing unit 500 includes an inlet roller pair 502 and a flapper 551. The inlet roller pair 502 directs a sheet transported from the main unit 101. The flapper 551 is disposed downstream of the inlet roller pair 502, and directs the sheet to a sort path 552 in a sorting mode and to a binding path 553 in a folding mode.

In a non-sorting mode, the sheet is directed by the flapper 551 into the sort path 552 and is discharged to an upper stack tray 18*a* and a lower stack tray 18*b* by the forward rotation of the discharge roller pair 560, which is rotatable in a forward direction and in a reverse direction. A punch unit (not shown) may also be mounted between the main unit 101 and the finisher 119 for punching through portions close to the trailing end of the sheets.

In the sorting mode, the sheet is directed by the flapper 551 into the sort path 552. The discharge roller pair 560 rotates by a predetermined amount of rotation in the forward direction and subsequently in the reverse direction so that the sheet is stacked on a processing tray (intermediate tray) 630. The sheets in a bundle stacked on the processing tray 630 are aligned as required and stapled by a stapler 601. Thereafter, the sheets are discharged by the discharge roller pair 560 onto the upper and lower stack trays 18*a* and 18*b* that are movable (automatically) upward and downward.

The folding unit 400 includes two pairs of stapler 818 that functions as a binding means and a folding roller pair 826 that functions as a folding means. The sheets discharged from the binding path 553 are accommodated in a storage guide 820 and then transported until the leading ends of the sheets move into contact engagement with a positioning member 823 that is movable upward and downward.

A projection member 825 functions as a projecting means and is disposed on the storage guide side of the folding roller pair 826 in such a way that the storage guide 820 is between the projection member 825 and the folding roller pair 826. When the projection member 825 that opposes the folding roller pair 826 projects toward the bundle of sheets stored in the storage guide 820, the bundle of sheets is pushed into a nip defined at the folding roller pair 826. Then, after being folded by the folding roller pair 826, the sheets are discharged into a saddle discharge tray 832.

The upper and lower stack trays 18*a* and 18*b* are mounted on the main unit 119A of finisher (FIG. 4) one above the other, being movable upward and downward. The forward and reverse rotations of stacker motors 209*a* and 209*b*, which are incorporated in the upper and lower stack trays 18*a* and 18*b* and serve as a moving means (drive means), are transmitted through a pinion gear 225 to a rack, not shown, formed on a part of a column 37. Thus, the upper and lower stack trays 18*a* and 18*b* can move upward and downward.

In the present embodiment, the upper stack tray 18*a* as a first tray is movable between a sheet stacking position where the sheets discharged from a sheet discharge port or outlet 36 are stacked and a retracted position located above the outlet 36. After the upper stack tray 18*a* has moved to the sheet stacking position, the upper stack tray 18*a* descends as the number of sheets on the upper stack tray 18*a* increases.

The lower stack tray 18*b* as a second tray is movable between home position HP as an initial position and the stacking position. When the sheets are to be stacked on the lower stack tray 18*b*, the upper stack tray 18*a* is first moved to the retracted position and then the lower stack tray 18*b* is moved to the sheet stacking position.

After having moved to the sheet stacking position, the lower stack tray 18*b* descends as the number of sheets increases. When the sheets are to be stacked on the upper stack tray 18*a* that has moved to the retracted position, the lower stack tray 18*b* is moved downward so that lower stack tray 18*b* does not interfere with the descending movement of the upper stack tray 18*a* as the upper stack tray 18*a* descends from the retracted position toward the sheet stacking position.

In the present embodiment, as described above, when the lower stack tray 18*b* is caused to descend as the upper stack tray 18*a* descends, the lower stack tray 18*b* is not moved down to the home position HP but enters a standby state above the home position HP.

Figure 3:
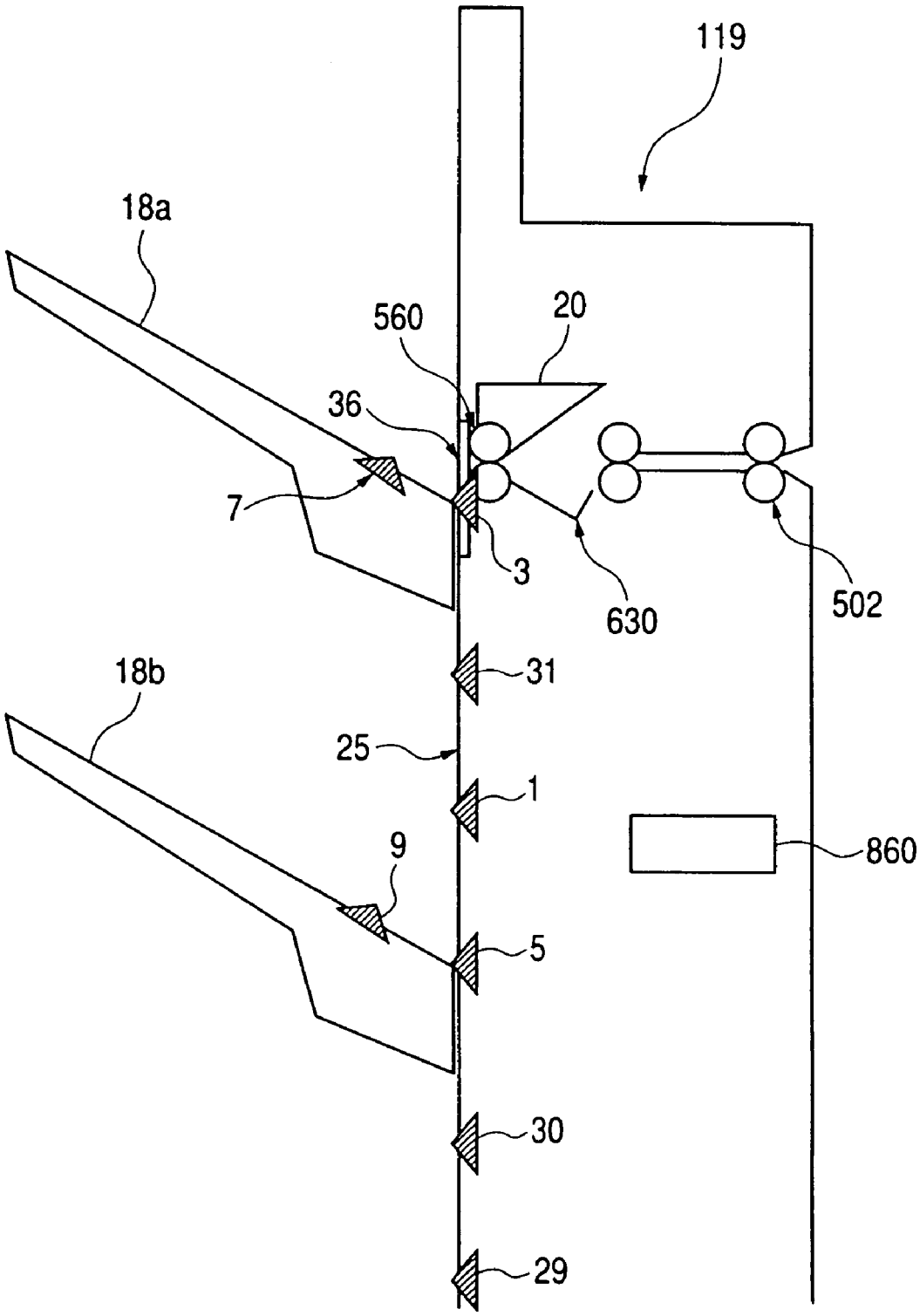
FIG. 3 illustrates the positions of various sensors disposed in the sheet post-handling apparatus.

As shown in FIG. 3, a sheet sensor 3 as a sheet surface sensor means is provided at the outlet 36 from which sheets or a stapled bundle of sheets is discharged. The sheet sensor 3 detects the top surface of the bundle of sheets stacked on the upper and lower stack trays 18 and 18*b*. When no sheet is stacked on the upper and lower stack trays 18*a* and 18*b*, the sheet sensor 3 detects the sheet stacking floor of the upper and lower stack trays 18*a* and 18*b*. With the aid of the output of the sheet sensor 3, the upper and lower stack trays 18*a* and 18*b* are moved to a position where the sheets stacked on the stack trays will not block the outlet 36.

The aforementioned sheet sensor 3 includes a flag (plate-like member) and a detecting section. The flag is urged outwardly of the finisher 119. The detecting section detects whether the flag has been pushed into the finisher 119. The flag detects the upper and lower stack trays 18*a* and 18*b* when no sheet is on the upper and lower stack trays 18*a* and 18*b*, or sheets on the upper and lower 18*a* and 18*b* when the sheets are on the stack trays 18*a* and 18*b*, thereby detecting that the flag has not been pushed into the finisher 119, and thus that the outlet 36 is not blocked. The sheet sensor 3 need not be a flag type sensor but may be a combination of a light emitting section and a light receiving section. For example, the light emitting section may be a infrared source that illuminates the sheets stacked on the upper and lower stack trays 18*a* and 18*b* or the sheet stacking floor of the upper and lower stack trays 18*a* and 18*b*. The light receiving section receives the light reflected by the top surface of the stacked sheets. Measuring the angle of reflection of the reflected light can detect the position of the top surface of the sheets on the stack tray sheets. A position detection signal obtained by these detecting means is input into a controller 860 provided in the main unit of the finisher 119A (or main unit 101).

In the present embodiment, in order to maintain a constant distance between the outlet 36 and the top surface of the sheets stacked on the upper and lower stack trays 18*a* and 18*b*, and in order to prevent the bundle of sheets stacked on the upper and lower stack trays 18*a* and 18*b* from leaning against the grating 25, the upper and lower stack trays 18*a* and 18*b* are first moved downward and then moved upward to a position where the sheet sensor 3 becomes ON.

Referring to FIG. 3, reference numeral 1 denotes a first lower limit sensor that detects a lower limit position of the upper and lower stack trays 18*a* and 18*b* that gradually descend as the number of sheets as stacked increases. An upper-surface sensor 5 is disposed below the first lower limit sensor 1. Reference numeral 29 denotes a second lower limit sensor as a lower-limit-of-lower-tray detecting means that detects a lower limit position of the lower stack tray 18*b*.

By disposing the upper surface sensor 5 below the first lower limit sensor 1 that limits the descending movement of the upper and lower stack trays 18*a* and 18*b*, when the sheets are stacked on the upper stack tray 18*a*, the upper stack tray 18*a* can be prevented from colliding the lower stack tray 18*b* or the sheets on the lower stack tray 18*b*, the lower stack tray being in the standby state at a position (referred to as an upper standby position where the upper surface sensor 5 detects the sheet stacking floor of the lower stack tray 18*a* or the top surface of the bundle of sheets on the lower stack tray 18*a*.

Reference numerals 31 and 30 denote a first lower limit front sensor and a second lower limit front sensor, respectively. The first and second lower limit front sensors (first and second pre-lower-limit sensors) 31 and 30 are disposed above the lower limit sensor. As the number of stacked sheets increases, the upper and lower stack trays 18*a* and 18*b* descend gradually to maintain the constant height of the paper surface detected by the sheet sensor 3. If the sheets have a dimension not more than 216 mm in the direction of transportation of the sheet, the first and second lower limit sensors 1 and 29 detect when the stack trays are full of sheets. If the sheets have a dimension more than 216 mm in the direction of transportation of the sheet, the first and second lower limit front sensors 31 and 30 detect when the stack trays are full of sheets.

The electrical hardware of the sheet post-handling apparatus will be described with reference to FIG. 5.

Figure 5:
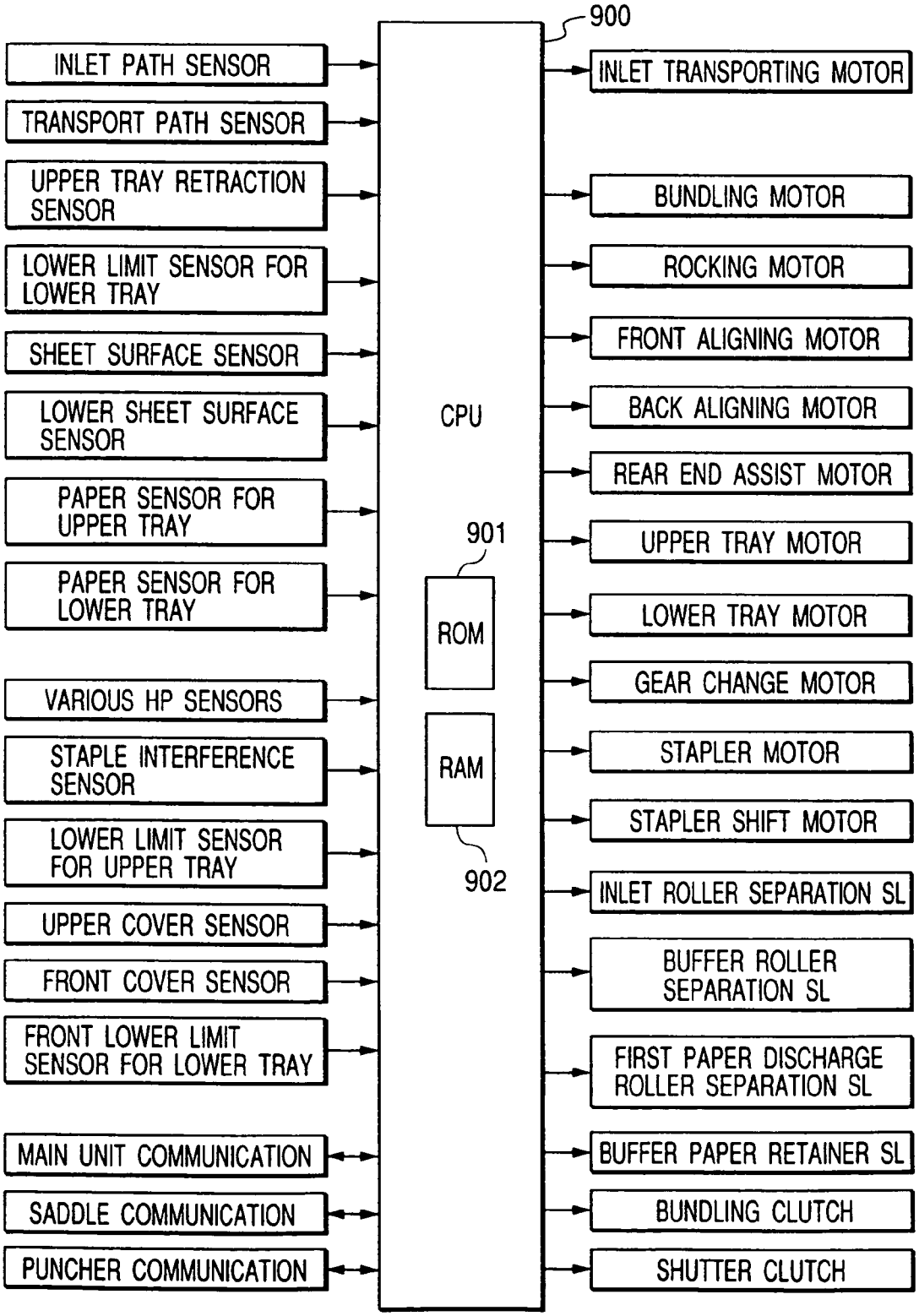
FIG. 5 is a block diagram illustrating an electrical hardware configuration for the sheet post-handling apparatus.

Referring to FIG. 5, reference numeral 900 denotes a CPU that reads data from a ROM 901 for storage and performs control and calculation, the data being temporarily stored in a RAM 902 as required. Respective motors, solenoids, clutches are controllably driven in accordance with information primarily input from various sensors, a main unit communication section, a saddle communication section, and a puncher communication section.

Sensors that provide signals to the CPU 900 include primarily an inlet path sensor, a transport path sensors, an upper tray retraction sensor, a lower limit sensor for lower tray, a sheet surface sensor, a lower sheet surface sensor, a paper sensor for upper tray, a paper sensor for lower tray, various home position (HP) sensors, a staple interference sensor, a lower limit sensor for upper tray, an upper cover sensor, a front cover sensor, and a lower limit front sensor for lower tray.

The CPU 900 provides control signals to various driving means: an inlet transporting motor, a bundling motor, a rocking motor, a front aligning motor, a back aligning motor, a rear-end assist motor, an upper tray motor, a lower tray motor, a gear change motor, stapler motor, a stapler shift motor, an inlet roller separation SL, a buffer roller separation SL, a first paper discharge roller separation SL, a buffer paper retainer SL, a bundling clutch, and a shutter clutch.

The sheet post-handling apparatus includes: a height controlling means in which that the CPU 900 controls the aforementioned drive motor to move a tray to its stacking positions in such a way that the upper surface of the tray detected by the sheet sensor 3 is below the outlet 36; a standby position detecting means which when another tray moves from above so that the top surface may be detected by the sheet sensor 3, detects that the tray or the sheet on the tray is detected at a standby position where movement of the tray to the stacking position is not interfered, the standby position being lower than the stacking position; and a distance detecting means that detects a movement distance of a tray driven by a drive motor to the standby position. The sheet post-handling apparatus also includes standby controlling means that causes a stack tray to stop when said distance detecting means has detected that the tray has moved from the stacking position already obtained to a position where the tray, sheets on the tray or the top of the sheets is positioned below and detected by the standby position detecting means.

The CPU 900 also provides a time measuring means. When the time measuring means detects that a tray has moved for a time period calculated based on a speed of the tray moving to the standby position and a distance from the stacking position already obtained to a position where the tray, sheets on the tray, or the top of the sheets is positioned below and detected by the standby position detecting means.

A description will be given of the operation of the invention for controlling and predicting the time required for switching stack trays at the discharge position of in the finisher 119. The operation will be described with reference to flowcharts in FIGS. 6 to 13. The control processing illustrated by the flowcharts is executed by the CPU 900 under the control of programs stored in the ROM 901 of FIG. 5.

Figure 6:
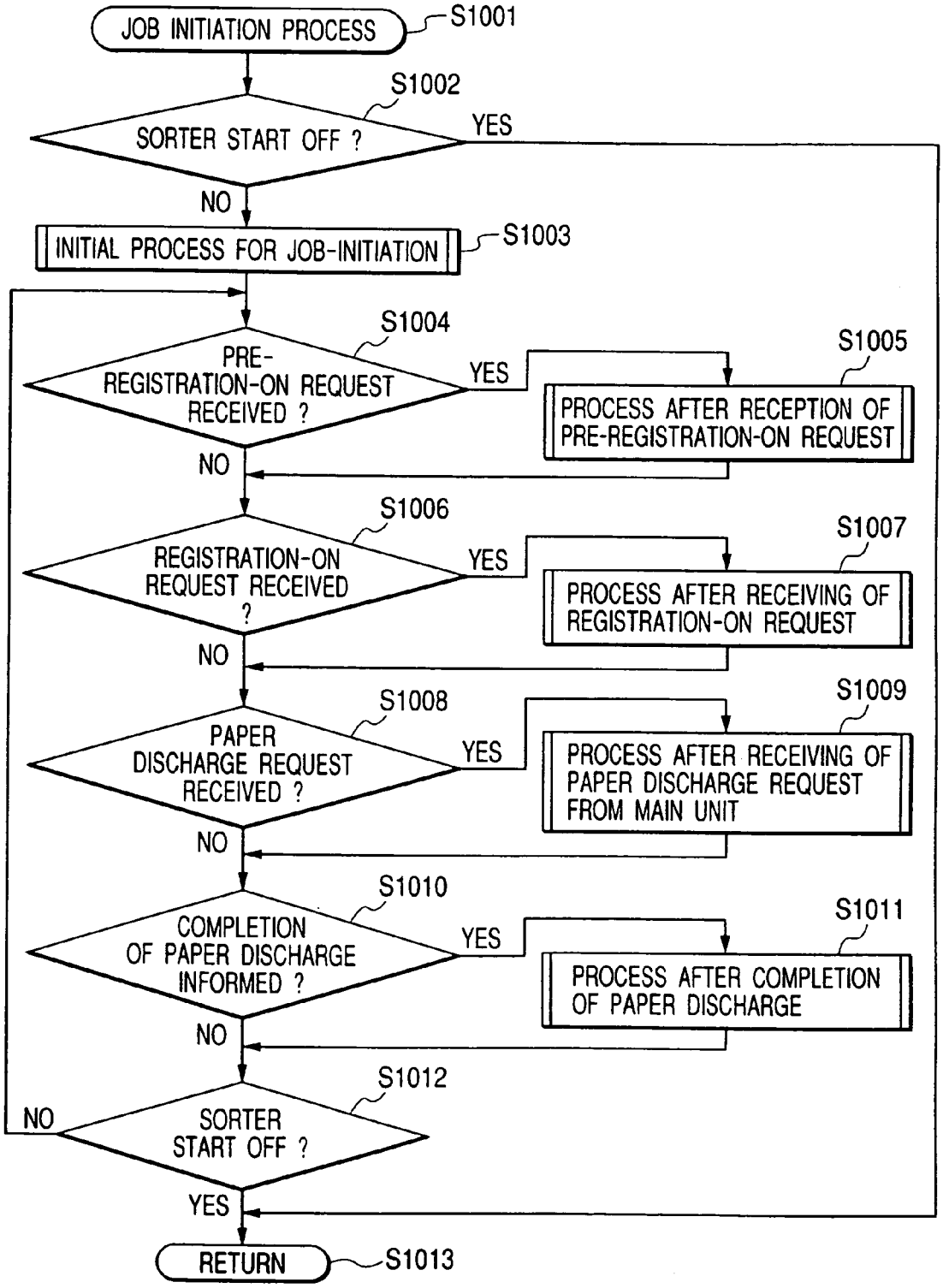
FIG. 6 is a flowchart illustrating a job-initiating operation of the embodiment.

First, a job initiation operation will be described with reference to the flowchart in FIG. 6.

A sorter start signal is checked to determine whether a job operation should be started (S1001, S1002). If the sorter start signal is ON, then the control of the job operation is performed at S1003-S1011. While the sorter start signal remains ON, it is monitored whether a pre-registration-ON request (S1004), a registration-ON request (S1006), and a sheet discharge request (S1008) have been received. While the sorter start signal remains ON, it is also monitored to determine whether the discharge operation by the finisher has completed (S1010).

Receiving the pre-registration request implies that data associated with, for example, paper size has received from the main unit. Upon receiving the pre-registration request, a process of reception-of-pre-registration request is performed (S1005). Receiving the registration-ON request implies that the main unit has just completed the registration control (S1007, details are not shown). Receiving the sheet discharge request indicates that the sheet has been discharged from the main unit, and a process after receiving of registration-ON request is performed (S1009) in which a discharge signal counter is compared with a paper ID identified by the pre-registration-ON signal that has been received and the paper transport by the finisher will begin using paper data corresponding to the paper ID (details are omitted). If the finisher performs paper transport so that the sheet has properly discharged under the control of paper transport, then a process after completion of paper discharge will be performed (S1011).

The aforementioned processing is repeated as long as the sorter start signal is ON at step S1012. An "OFF" at step S1012 indicates that the job has been completed (S1013).

Figure 7:
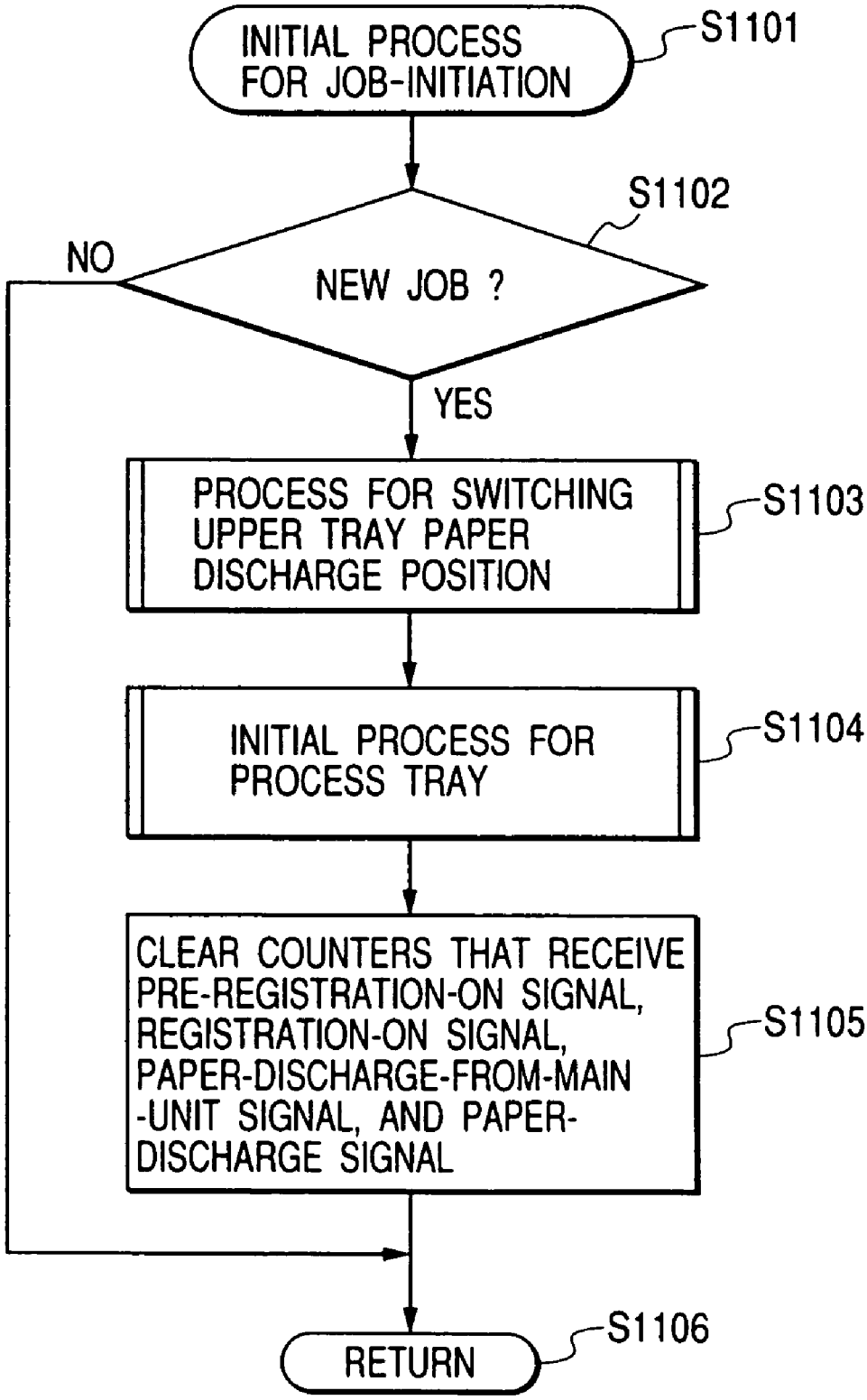
FIG. 7 is a flowchart illustrating an initial process for job initiation of the embodiment.

The operation for the initial process for job initiation will be described with reference to a flowchart in FIG. 7.

When an initial process for job initiation begins at step S1101, if the job is a new job, a process for switching upper tray paper discharge position (S1103) and an initial process for process tray (S1104) (not shown) are performed. After these initial processes have completed, counters for receiving a pre-registration-ON signal, a registration-ON signal, a discharge-from-main-unit signal counter, and a paper discharge counter are cleared (S1105), thereby completing the initial process for job initiation (S1106).

Figure 8:
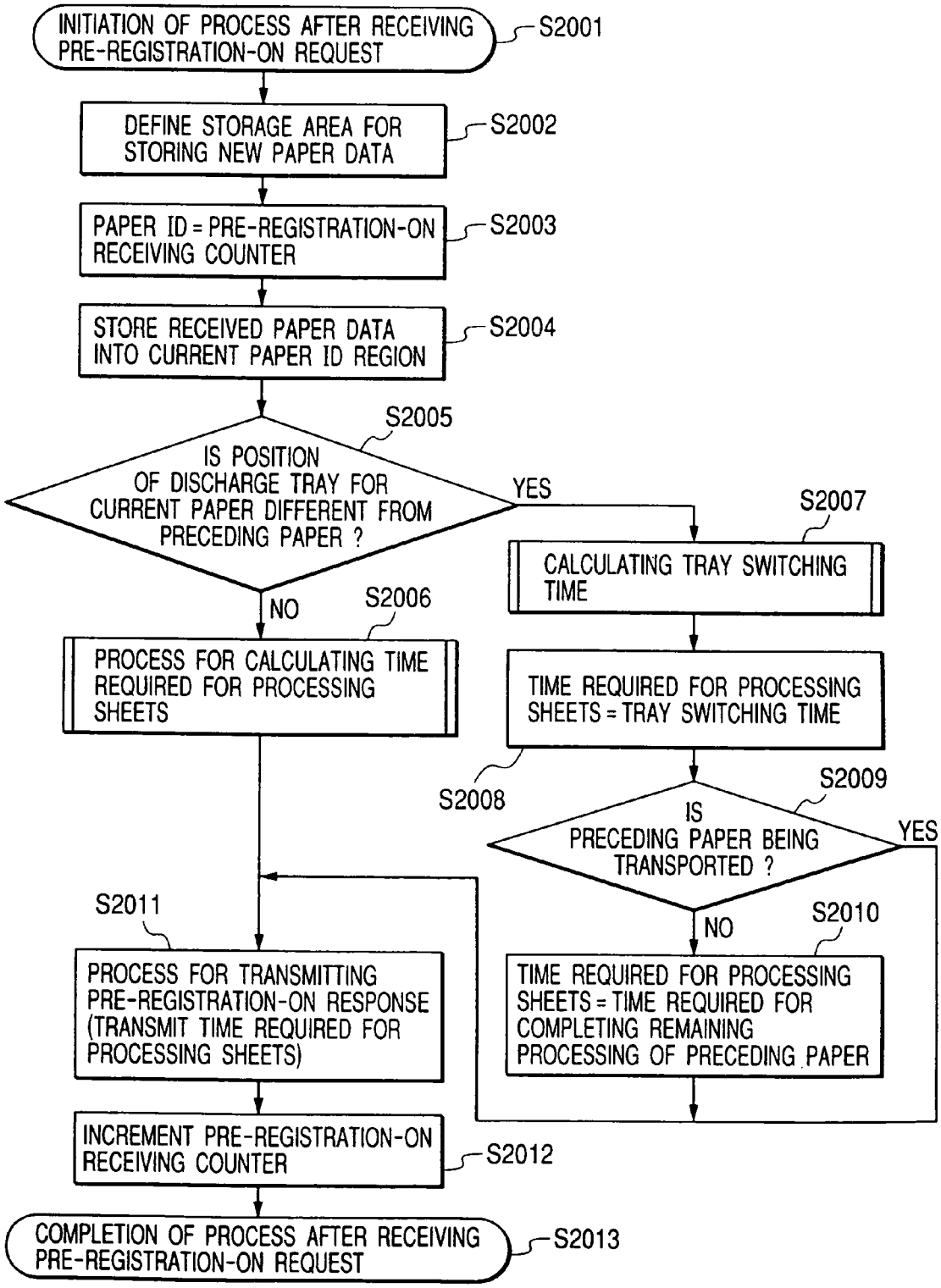
FIG. 8 is a flowchart that illustrates a pre-registration-ON requesting operation of the embodiment.

The aforementioned operation for performing a process after receiving a pre-registration-ON request will be described with reference to the flowchart in FIG. 8.

Upon receiving a pre-registration-ON request signal indicating that the image forming apparatus connected to the finisher has newly begun the control of paper (S2001), a paper data storage area is defined (2002). Then, a pre-registration-ON receiving counter is defined in a paper ID which is a part of the storage area defined. Thus, the pre-registration-ON receiving counter serves as a paper ID (S2003). Thereafter, data associated with the paper, which is received together with the pre-registration-ON request, is stored into the above-defined paper data storage area (S2004).

The above-described data associated with the paper includes discharge position data indicating to which stack tray the sheet should be discharged. The discharge position data is compared with a preceding paper ID stored in the storage area. If the preceding paper ID is absent from the storage area or different from a current paper ID, then a check is made to determine whether the current paper ID is different from a current stack tray at the discharge position (S2005). That is, if no switching of stack trays is required, then the time required for processing the sheet is calculated at S2006.

When switching of stack trays is required, then the time required for switching trays is calculated at S2007 and the calculated time length is stored as the time required for processing sheets (S2008). Timings at which trays are switched depend on an operation mode in which the preceding sheet is processed. If the preceding paper is still being transported (S2009), the time required for completing the remaining portion of the process for the preceding paper is calculated based on the paper data for the preceding paper. Then, the thus calculated time is added to the time required for processing sheets that has been stored, thereby correcting the time required for switching trays (S2010).

The thus obtained data describing the time required for processing sheets is added to a pre-registration-ON response signal and transmitted to the main unit (S2011). Upon receiving the time required for processing sheets added to the pre-registration response signal, the main unit must wait at least the time required for processing sheets after initiation of the discharge of the preceding paper, before discharging the paper that corresponds to the pre-registration-ON signal. In this manner, the process after receiving a pre-registration-ON request is completed (S2012).

Figures 9, 9A:
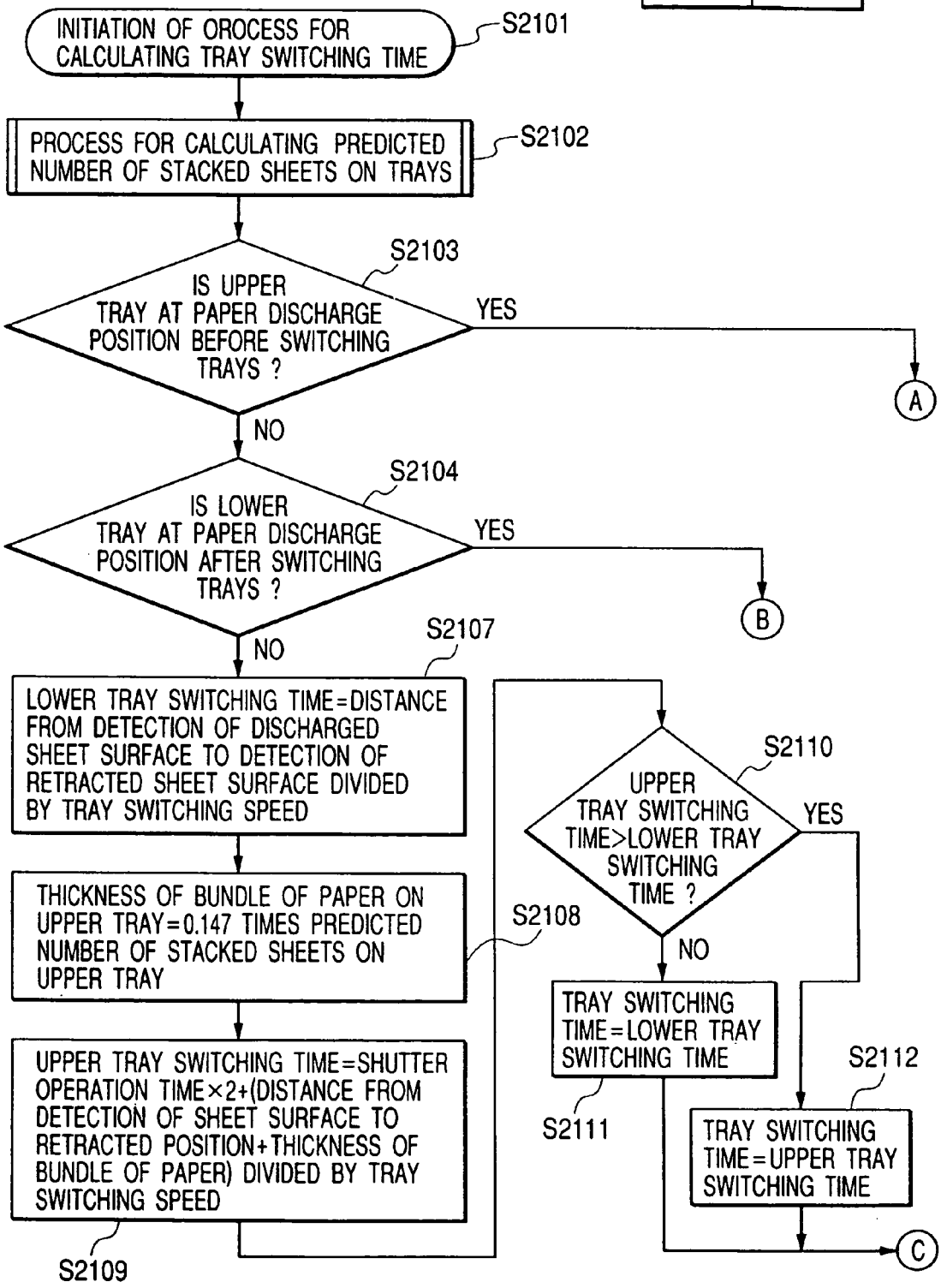
FIG. 9 is comprised of FIGS. 9A and 9B showing a flowchart that illustrates a tray-switching time calculating operation of the embodiment.
Figure 9B:
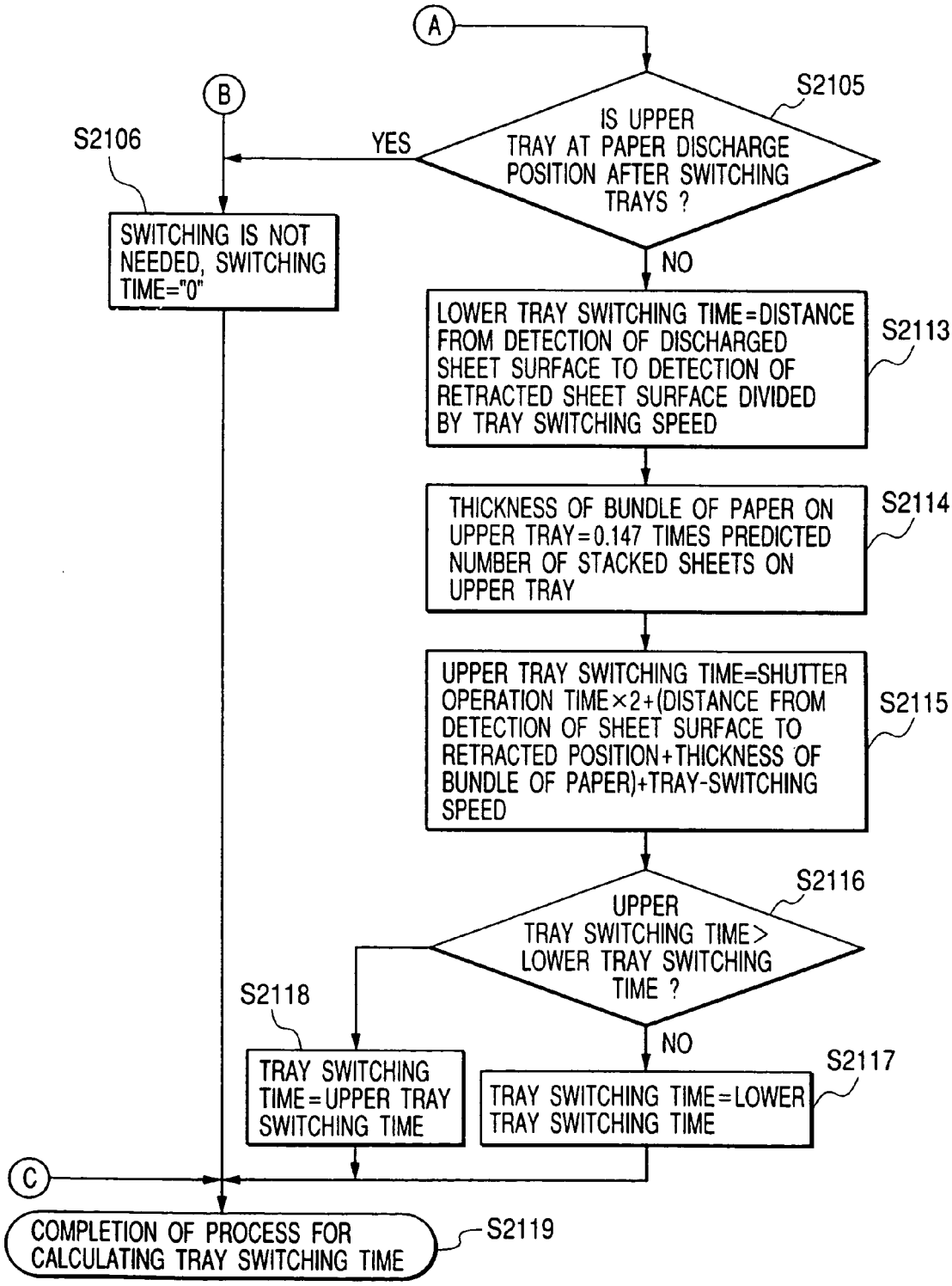

A process for calculating time required for switching trays will be described with reference to a flowchart in FIGS. 9A and 9B.

Upon initiating the process for calculating time required for switching trays (S2101), a process for calculating the predicted number of sheets stacked on a tray is performed (S2102). The detail of the calculation of the predicted number of stacked sheets in tray will be described later. In brief, data describing the number of sheets stacked in each tray shortly before a sheet is discharged is predicted and stored. Then, in order to determine which tray should be set at the discharge position, the positions of the trays before they are switched are compared with the positions of the trays after they are switched at S2103-S2105. If no tray needs to be switched, the switching time is zero (0) msec (S2106).

Switching from the lower stack tray to the upper stack tray is accomplished by executing a sequence of steps S2107-S2112. Calculation is made to determine the time required for the lower stack tray to move to the discharge position and the time required for the upper stack tray to move to the discharge position and the longer is stored as a tray switching time (S2110-S2112). The switching time for the lower stack tray is given by the distance from the sheet sensor 3 to the upper surface sensor 5 divided by a tray switching speed (S2107). In order to shorten the switching time, the thickness of sheets stacked on the upper stack tray is calculated based on the predicted number of sheets (S2108), and then the time required for the tray to move to the discharge position is calculated from the distance over which the upper stack tray moves to the discharge position. For the upper stack tray, the time required for the shutter to operate before and after the upper stack tray moves should be taken into account. Therefore, the switching time for the upper stack tray is given by "the time required for the shutter to operate" times "two (2)" plus "the time required for the upper stack tray to move to the discharge position" (S2109).

Switching from the upper stack tray to the lower stack tray is accomplished by executing a sequence of steps S2113-S2118. Calculation is also made to determine the time required for the lower stack tray to move to the discharge position and the time required for the upper stack tray to move to the discharge position and the longer is stored as a tray switching time (S2116-S2118). The switching time for the lower stack tray is given by the distance from the sheet sensor 3 to the upper surface sensor 5 divided by the tray switching speed (S2113). Likewise, for the upper stack tray, the thickness of sheets stacked on the upper stack tray is calculated based on the predicted number of sheets (S2114), and then the time required for the upper stack tray to move to the discharge position is calculated from the distance over which the upper stack tray moves to the discharge position. The time required for the shutter to operate should also be taken into account before and after the upper stack tray moves. The switching time for the upper stack tray is given by "the time required for the shutter to operate" times "two (2)" plus "the time required for the upper stack tray to move to the discharge position" (S2115), thus completing the process (S2119).

Figure 10:
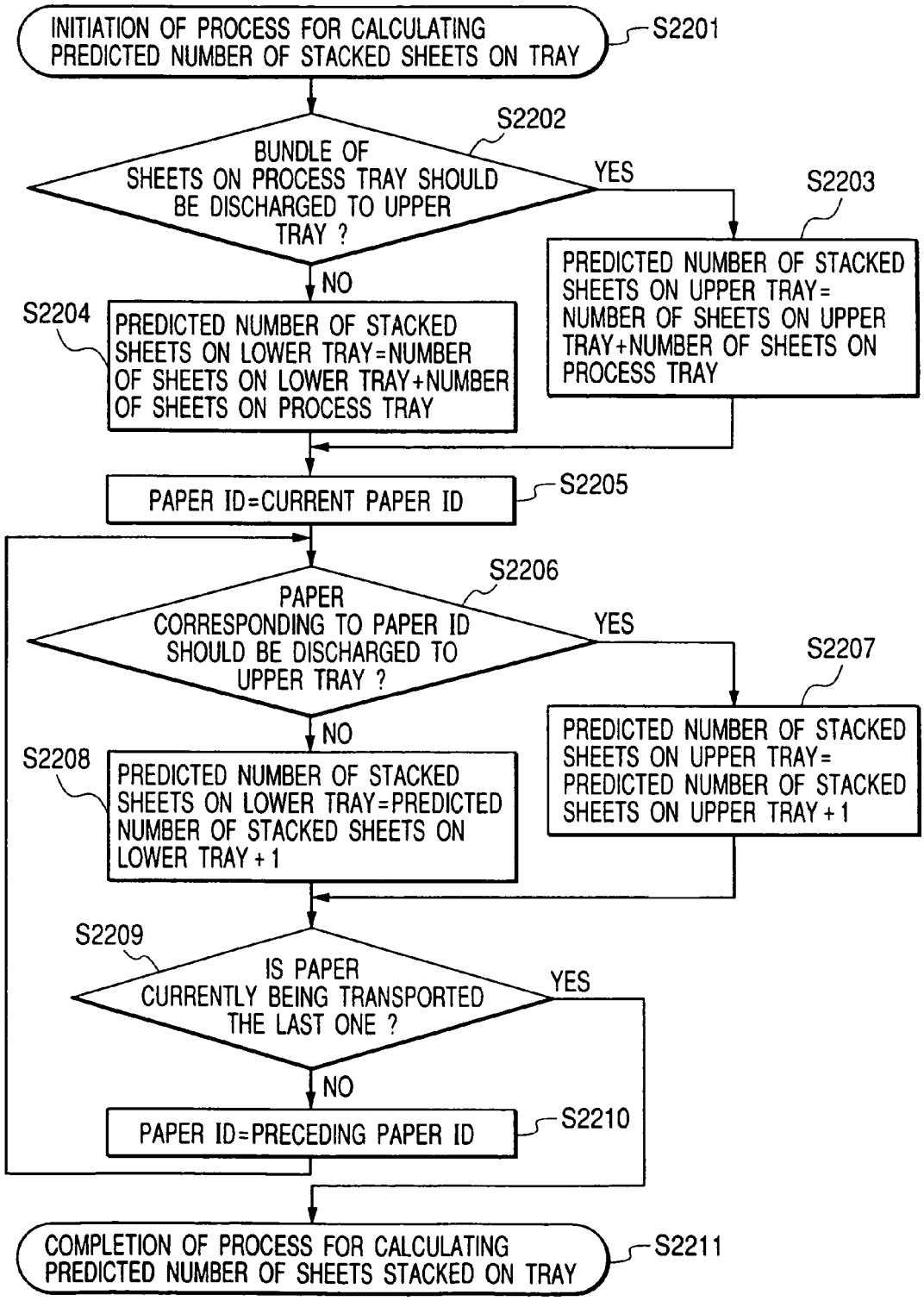
FIG. 10 is a flowchart that illustrates a number-of-stacked-sheets predicting operation of the embodiment.

A process for calculating a predicted number of sheets stacked on a stack tray will be described with reference to a flowchart in FIG. 10.

Upon initiation of the process (S2201), a check is made to determine to which stack tray the bundle of sheets on the process tray should be discharged (S2202). If the bundle of sheets should be discharged to the upper stack tray, then the number of sheets on the upper stack tray is added to the number of sheets on the process tray and the sum is stored as a predicted number of sheets to be stacked on the upper stack tray (S2203). If the bundle of sheets should be discharged to the lower stack tray, the number of sheets on the lower stack tray is added to the number of sheets on the process tray and the sum is stored as a predicted number of stacked sheets on the lower stack tray (S2204).

Then, a current paper ID is stored, so that a sheet being transported in the finisher, a sheet being transported in the main unit, and a sheet to be fed from the main unit are all checked to determine a tray to which the sheet should be discharged (S2205). Then, a check is made to determine to which tray the sheet corresponding to the stored paper ID should be discharged (S2206). If the sheet should be discharged to the upper stack tray, then one (1) is added to the predicted number of stacked sheets for upper stack tray that has been stored (S2207). Likewise, if the sheet should be discharged to the lower stack tray, then one (1) is added to the predicted number of stacked sheets for lower stack tray that has been stored (S2208). Then, if a sheet to be discharged is the final sheet, calculation of the predicted number of stacked sheets is terminated (S2209, S2111). If a sheet to be discharged is not the final sheet, a preceding sheet that corresponds to the paper ID is overwritten as a paper ID (S2210).

Figure 11:
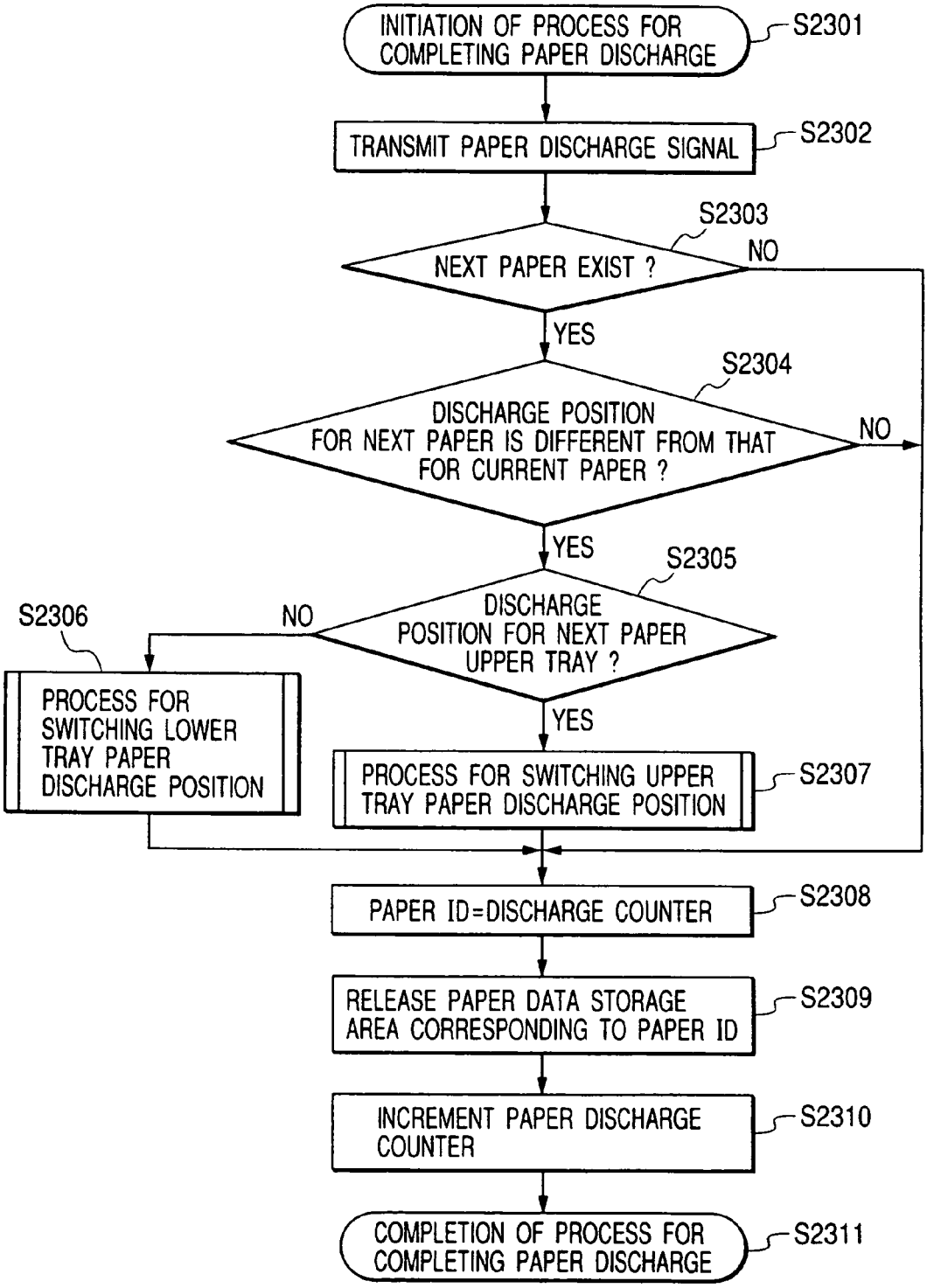
FIG. 11 is a flowchart that illustrates a paper-discharge completing operation of the embodiment.
Figure 12:
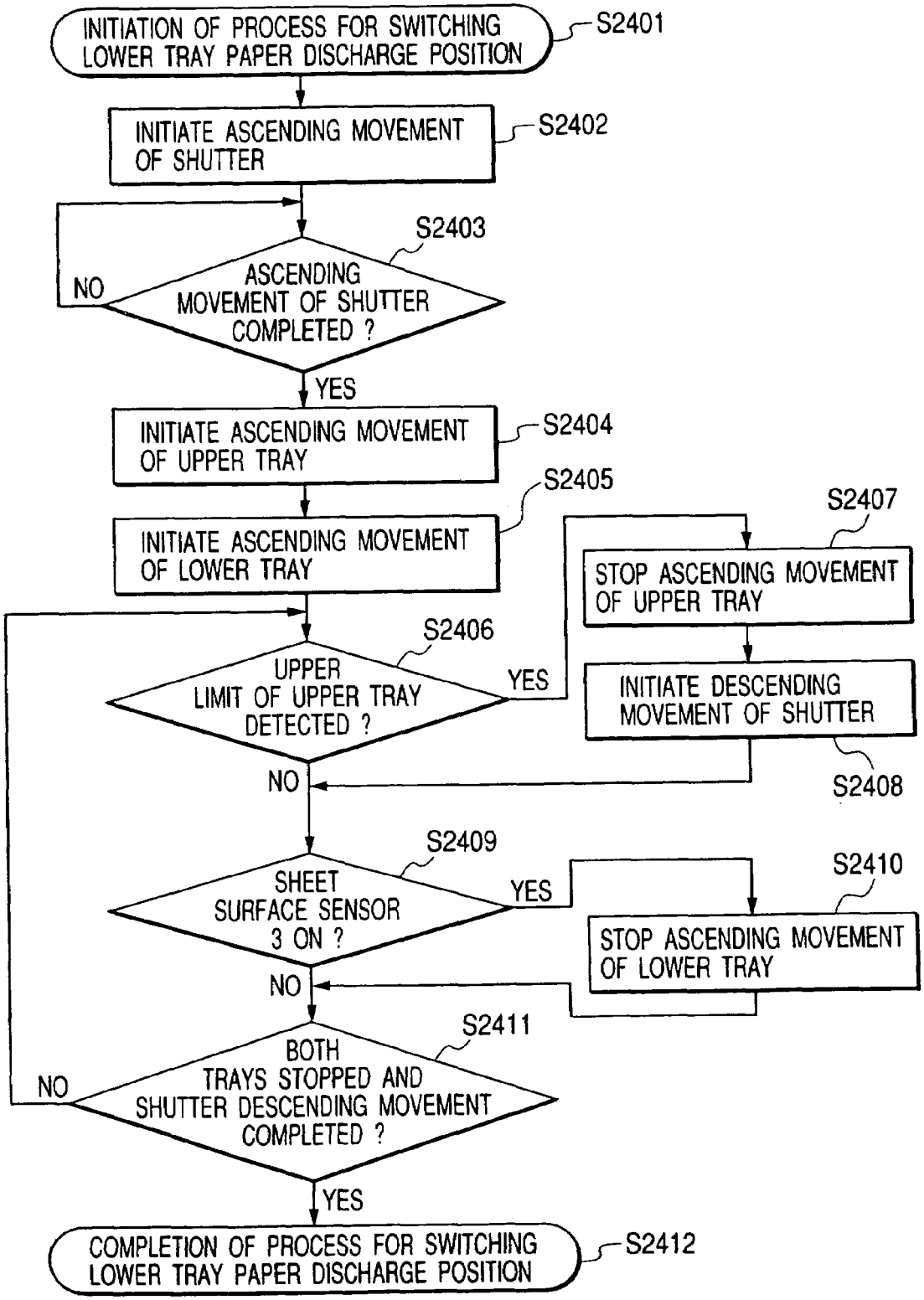
FIG. 12 is a flowchart that illustrates a lower-tray position switching operation of the embodiment.
Figures 13, 13A:
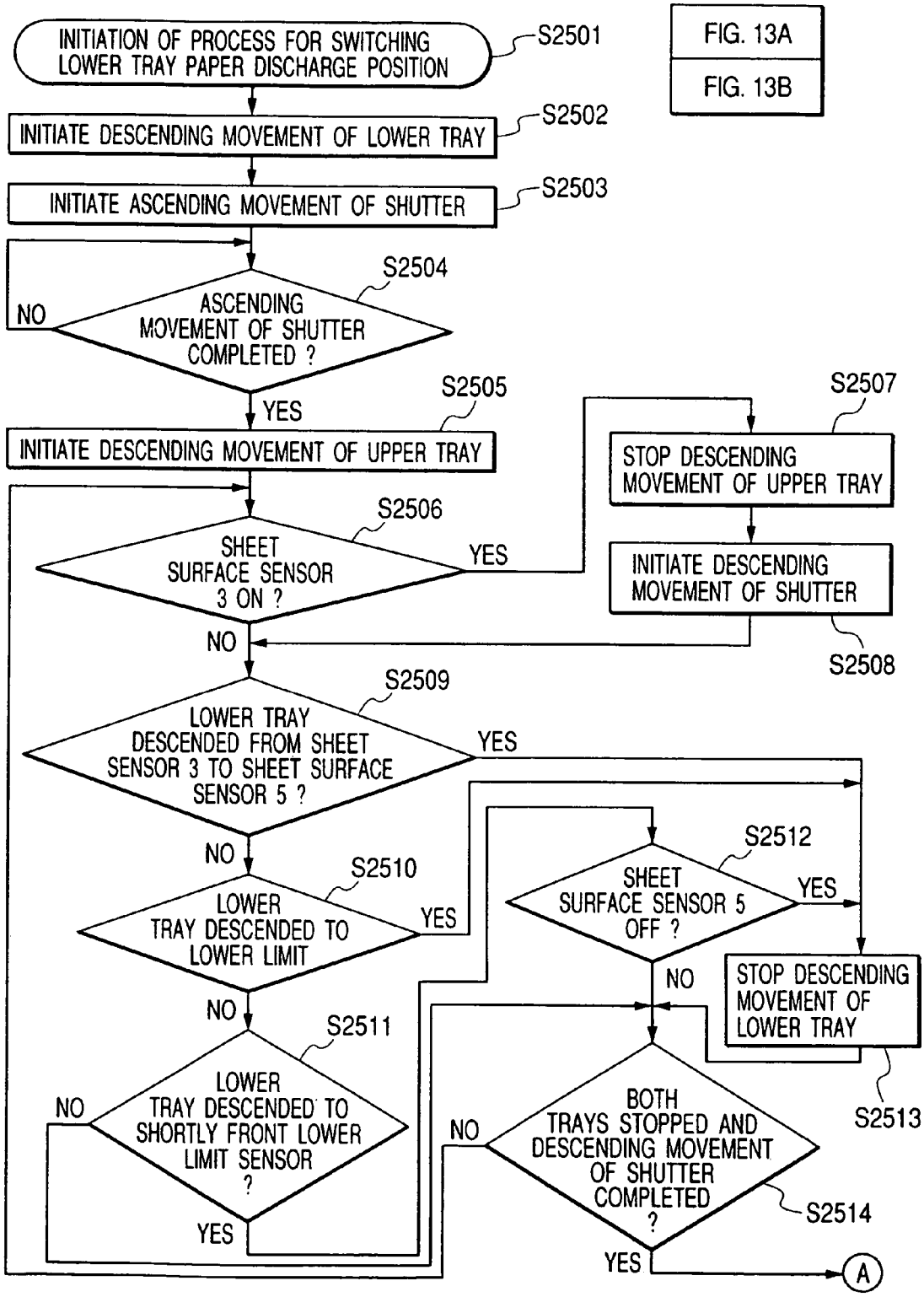
FIG. 13 is comprised of FIGS. 13A and 13B showing a flowchart that illustrates an upper-tray position switching operation of the embodiment.
Figure 13B:
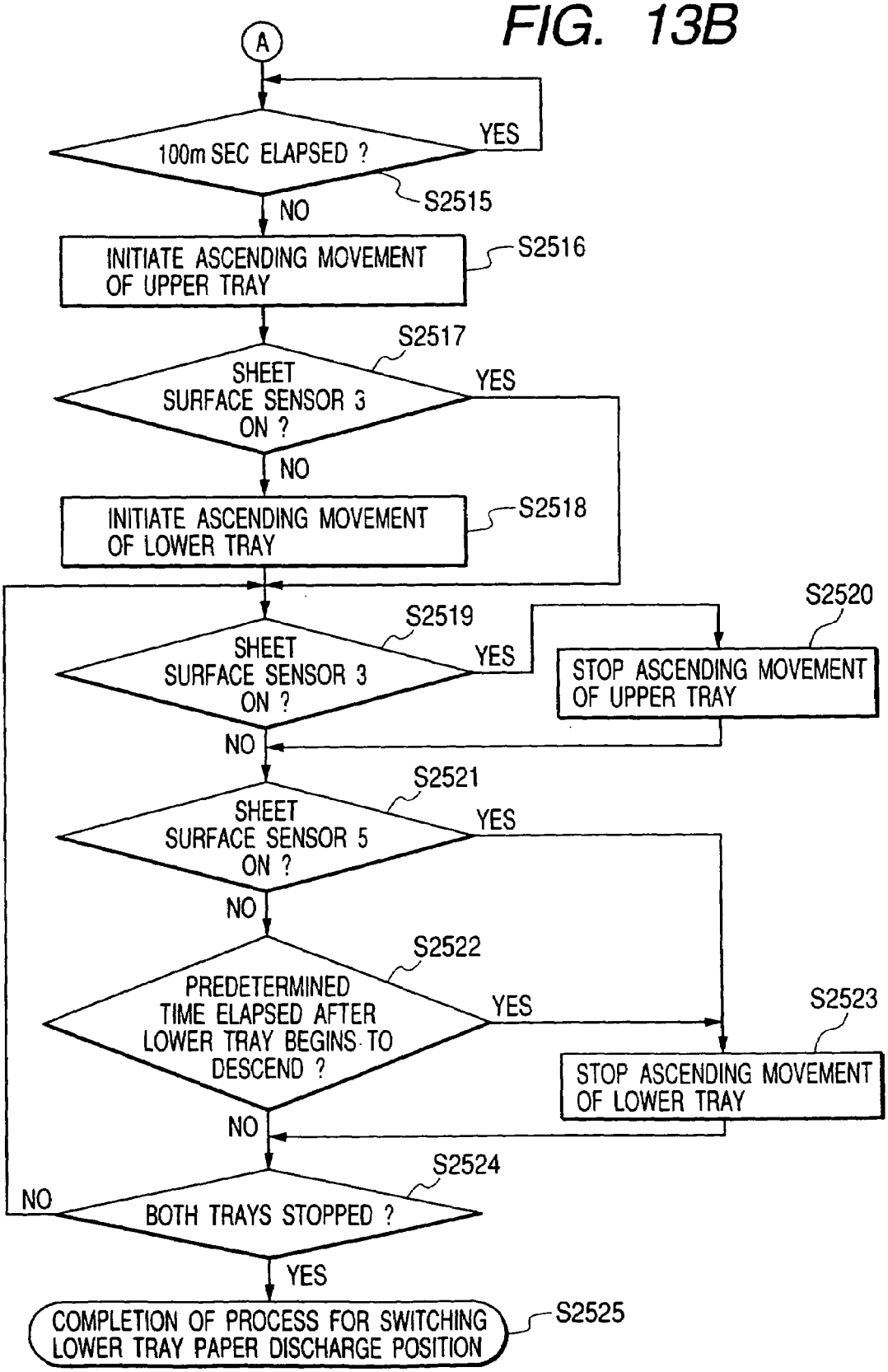

A process for completing paper discharge will be described with reference to a flowchart in FIG. 11.

When a process for completing paper discharge is initiated (S2301), the finisher transmits to the main unit a paper discharge signal indicating that the paper has been discharged normally (S2302). Then, if the next paper is to be discharged to a stack tray different from a stack tray currently at the discharge position, a tray-switching operation is performed (S2304, S2305). If the paper is to be discharged to the upper stack tray (S2305), the process for switching the upper tray paper discharge position is performed (S2307). If the paper is to be discharged to the lower stack tray, the process for switching lower tray paper discharge position is performed (S2306).

This completes all of the paper-transport control. Subsequently, the paper ID is set to the paper discharge counter (S2308) and a paper data storage area is deleted which has been preserved upon the pre-registration-ON request and corresponds to the paper ID (S2309). Then, the paper discharge counter is incremented (S2310) to complete the process for completing paper discharge (S2311).

The operation for switching stack trays will be described.

When a preceding sheet has been discharged to the upper stack tray 18*a* and a following sheet is to be discharged to the lower stack tray 18*b*, the lower stack tray 18*b* is moved to a position required for discharging the following sheet. A description will be given of this operation for switching the discharge position with reference to the flowchart in FIG. 12.

When a sheet is to be discharged to the upper stack tray 18*a*, the upper stack tray 18*a* is positioned so that the top surface of the sheets on the upper stack tray 18*a* is below the outlet 36. The upper stack tray 18*a* can take up this position when the ascending movement of the upper stack tray 18*a* is stopped after the sheet sensor 3 detects the top surface of the sheets. The lower stack tray 18*b* is resting at a position where the upper surface sensor 5 detects the top surface of the stack of sheets or at a position where the top surface of the stack of sheet is below the upper surface sensor 5.

With this situation, if a sheet is to be discharged to the lower stack tray 18*b*, the upper stack tray 18*a* needs to retract to a position above the outlet 36, thereby allowing the lower stack tray 18*b* to ascend.

First, the shutter member (not shown) is caused to ascend to close the outlet 36, thereby preventing the sheets stacked on the stack trays from moving in a reverse direction (S2402). Upon completion of the ascending movement of the shutter (S2403), the upper stack tray 18*a* initiates its ascending movement (S2404) and the lower stack tray 18*b* initiates its ascending movement from a position where the upper surface sensor 5 detects the top surface of the stack of sheets or a position where the top surface of the stack of sheet is below the upper surface sensor (S2405).

The upper stack tray 18*a* ascends to an upper limit above the outlet 36 (S2406, S2407), so that the upper stack tray 18*a* does not interfere with the operation for discharging a sheet to the lower stack tray 18*b*. After the ascending movement of the upper stack tray 18*a*, the shutter (not shown) is caused to descend to open the outlet 36 (S2408). The ascending movement of the lower stack tray 18*b* continues until the sheet sensor 3 detects the top surface of the stack of sheets (S2409, S2410).

This completes switching from the upper stack tray 18*a* to the lower stack tray 18*b* at the discharge position (S2411, S2412).

When a preceding sheet has been discharged to the lower stack tray 18*b* and a following sheet is to be discharged to the upper stack tray 18*a*, the upper stack tray 18*a* is moved to a position required for discharging the following sheet. A description will be given of this operation for switching the discharge position with reference to the flowchart in FIGS.

13A and 13B. The CPU 900 executes the program stored in the ROM 901 in FIG. 5 to perform the control process illustrated by the flowchart.

As described above, when a sheet is discharged to the lower stack tray 18*b*, the upper stack tray 18*a* is above the outlet 36 and the lower stack tray 18*b* is at a position where the sheet sensor 3 detects the top surface of the sheets stacked on the lower stack tray 18*b*.

With this situation, when a sheet is to be discharged to the upper stack tray 18*a*, the lower stack tray 18*b* is first caused to descend (S2502). At the same time, the shutter member (not shown) is caused to ascend to close the outlet 36 and then the upper stack tray 18*a* is allowed to descend (S2503), thereby preventing the sheets stacked on the stack trays from moving in a reverse direction. Upon completion of the ascending movement of the shutter (S2504), the upper stack tray 18*a* initiates its descending movement (S2505). When the sheet sensor 3 detects the top surface of the stack of sheets on the upper stack tray 18*a* (S2506), the descending movement of the upper stack tray 18*a* is terminated (S2507) and the shutter member (not shown) is caused to descend to open the closed outlet 36 (S2508).

While the upper stack tray 18*a* is descending, the lower stack tray 18*b* that has initiated its descending movement will stop at one of the three timings without the upper surface sensor 5: (1) when the lower stack tray 18*b* has moved from the sheet sensor 3 to the upper surface sensor 5 (S2509), (2) when the lower stack tray 18*b* has moved to the lower limit (S2510), (3) when the lower stack tray 18*b* has moved to a front lower limit sensor for lower tray and the upper surface sensor 5 is OFF (S2511, S2512).

The upper stack tray 18*a* initiates its ascending movement (S2516) after the elapse of 100 msec (S2515) if the lower stack tray 18*b* and the shutter stop moving (S2514).

The lower stack tray 18*b* is controlled at step S2509 in such a way that when the lower stack tray 18*b* is caused to descend from the sheet sensor 3 to the upper surface sensor 5, the upper surface sensor 5 is ON. In other words, the lower stack tray 18*b* is controlled in such a way that the lower stack tray 18*b* descends over the distance from a position where the upper surface sensor 5 becomes ON to a position where the upper surface sensor 5 is just about to become OFF. Therefore, when the lower stack tray 18*b* stops its descending movement, the upper surface sensor 5 is normally ON. In this manner, when the switching is accomplished from the lower stack tray 18*b* to the upper stack tray 18*a*, the lower stack tray 18*b* need not ascend shortly after the lower stack tray 18*b* is caused to descend (S2517, S2518).

When the user removes the bundle of sheets stacked on the lower stack tray 18*b* during descending movement, the upper surface of the stack tray 18*b* becomes lower than when the lower stack tray 18*b* initiated its descending movement. Thus, the upper surface sensor 5 may become OFF after the lower stack tray 18*b* has descended over a distance. In that case, the lower stack tray 18*b* is caused to ascend until the upper surface sensor 5 becomes ON (S2521, S2523).

If the time required for switching trays, calculated by the process for calculating time required for switching trays, has elapsed since the lower stack tray 18*b* initiates its descending movement before the upper surface sensor 5 becomes ON, the ascending movement of the lower stack tray 18*b* is terminated, thereby restricting the time over which the lower stack tray moves (S2522). The upper stack tray 18*a* is allowed to ascend until the sheet sensor 3 become ON (S2519, S2520). When the both stack trays have completed their ascending movements, the switching from the lower stack tray 18*b* to the upper stack tray 18*a* completes (S2520).

The descending movement of the stack tray may also be terminated according to the time obtained from the aforementioned distance and the speed in the descending movement instead of the aforementioned distance.

In the above description, the distance over which the lower stack tray 18*b* descends is from the sheet sensor 3 to the upper surface sensor 5. Even when the user places a stack of sheets on the lower stack tray 18*b* during the descending movement of the lower stack tray 18*b*, if priority should be given to sure movement of the lower stack tray 18*b* to a position where the lower stack tray 18*b* or the top surface of the stack of sheets on the lower stack tray 18*b* does not interfere with the upper stack tray 18*a*, the distance over which the lower stack tray 18*b* descends may be set to the sum of the distance from the sheet sensor 3 to the upper surface sensor 5 and the thickness of the stack of sheets to be placed on the lower stack tray 18*b*.

The embodiment reliably completes switching of stack trays within a predetermined time length while the lower tray is ensured to have a level of top surface required to enter a standby state.

The embodiment has been described with respect to a sheet handling apparatus in which a process for binding sheets is performed, and an image forming apparatus that is provided with such a sheet handling apparatus. The present invention is not limited to this case but may be applicable to an apparatus having more than two trays.

Figure 4:
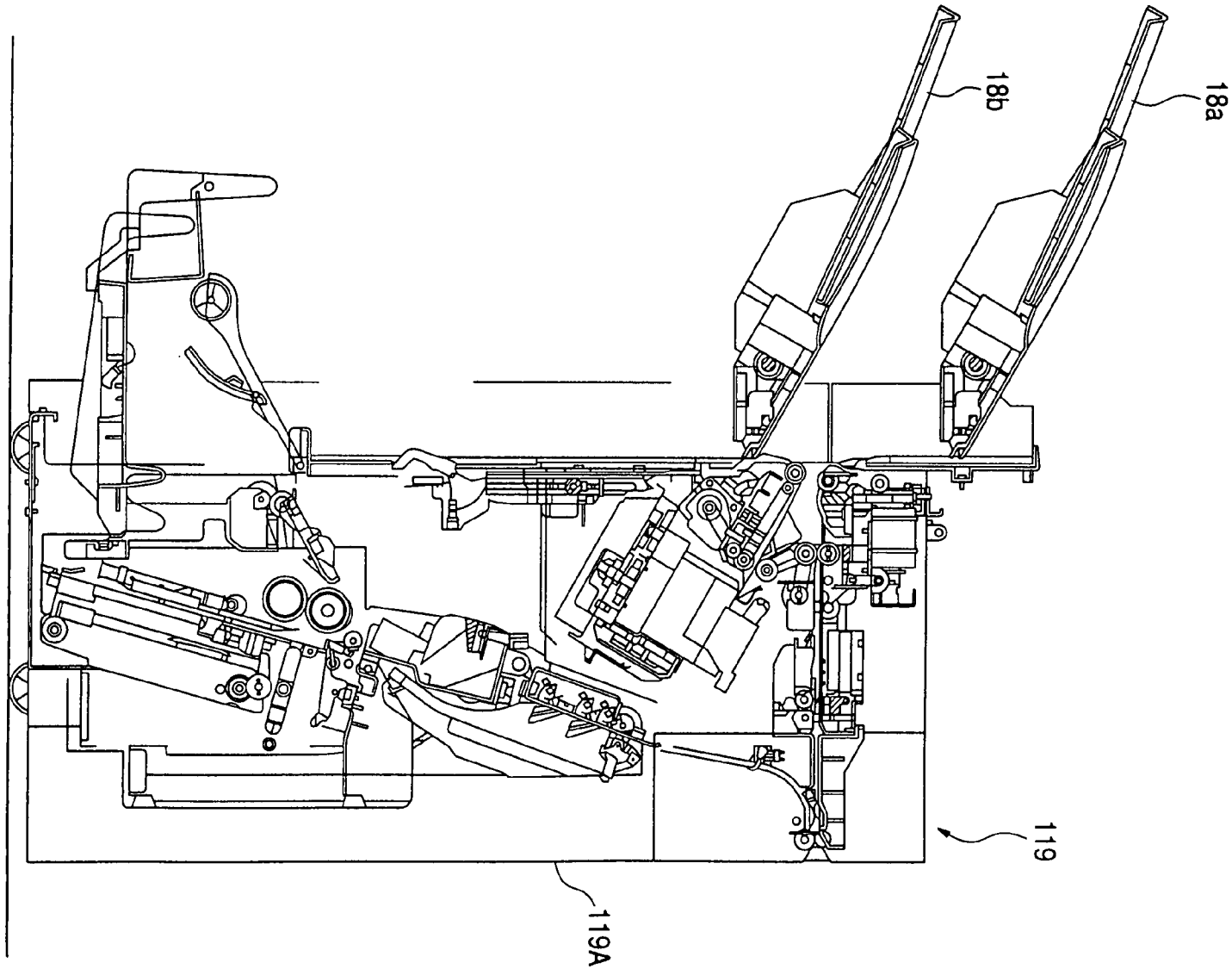
FIG. 4 illustrates the upward and downward movements of stack trays.

A second embodiment will be described. FIGS. 1, 2, and 4 have been described in the first embodiment and therefore are omitted their description.

In this embodiment, the lower stack tray 18*b* descends as the upper stack tray 18*a* descends, however, the lower stack tray 18*b* is not caused to descend to the home position HP but is caused to enter a standby state above the home position HP. This operation can shorten the time required for the lower stack tray 18*b* to move to the discharge position when sheets are stacked on the lower stack tray 18*b* next time.

Figure 14:
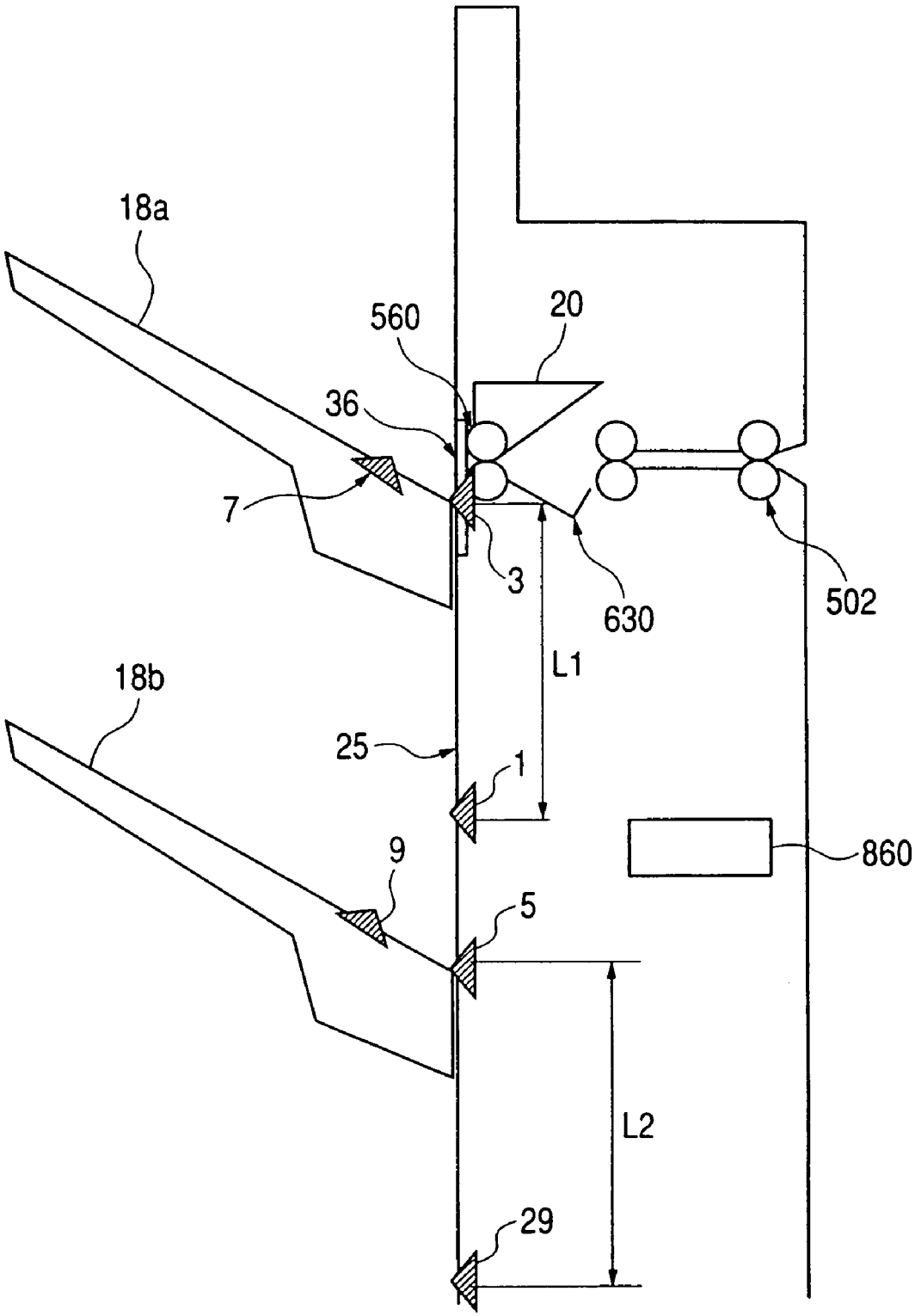
FIG. 14 illustrates various sensors disposed in the sheet post-handling apparatus.

As shown in FIG. 14, the sheet sensor 3 is provided at the outlet 36 through which sheets or a stack of stapled sheets is to be discharged to the upper stack tray 18*a* or the lower stack tray 18*b*. The sheet sensor 3 detects the top surface of the sheets or a stack of sheets on the upper and lower stack trays 18*a* and 18*b*. If no sheet is on the stack tray, the sheet sensor 3 detects the sheet stacking floor of the stack tray on which the sheets are placed. By using this sheet sensor 3, the upper and lower stack trays 18*a* and 18*b* can be moved to a position where the sheets stacked on the stack trays will not block the outlet 36.

The sheet sensor 3 includes a detecting section that detects the flag (plate-like member) urged outwardly from the finisher 119 and detects whether the flag has been pushed into the finisher 119. When no sheet is on the stack tray 18*a* or 18*b*, if the sheet sensor 3 detects that flag has not been pushed into the finisher 119 by the stack tray 18*a* or 18*b*, then it is determined that the outlet 36 is not blocked. When sheets are on the stack tray 18*a* or 18*b*, if the sheet sensor 3 detects that the flag has not been pushed into the finisher 119 by the sheets on the stack tray 18*a* or 18*b*, then it is determined that the outlet is not blocked.

The sheet sensor 3 need not be a flag type sensor but may be selected from a variety of types of sensors. For example, the sheet sensor may include a light emitting section and a light receiving section. The light emitting section emits, for example, infrared that illuminates the top of the sheets on the stack trays 18*a* and 18*b* or the sheet stacking floor of the stack trays 18*a* and 18*b* on which the sheets are to be placed. The light receiving section receives light reflected back by the sheets. By measuring the reflection angle, the position of the top surface of the sheets placed on the tray can be detected.

The position detection signals generated by these detecting means are input to a controller 860 provided in the finisher 119A (or main body 101).

In the second embodiment, in order that the distance between the outlet 36 and the top surface of the stack of sheets on the upper and lower stack trays 18*a* and 18*b* is maintained constant and that the sheets on the upper and lower stack trays 18*a* and 18*b* do not lean against the grating 25, the upper and lower stack trays 18*a* and 18*b* are first moved downward and then moved up to a position where the sheet sensor 3 becomes ON.

Referring to FIG. 14, the upper surface sensor 5 detects the sheet stacking floor of the lower stack tray 18*b* on which the sheets are placed, or the top surface of the sheets stacked on the floor of the stack tray 18*b*.

By disposing the upper surface sensor 5 at this position, when the sheets are to be stacked on the upper stack tray 18*a*, the lower stack tray 18*b* is not moved to the home position HP but to a position above the home position HP at which the upper surface sensor 5 can detect the sheet stacking floor of the lower stack tray 18*b* on which the sheets are placed, or the top surface of the sheets stacked on the sheet stacking floor of the lower stack tray 18*b*.

In this manner, the lower stack tray 18*b* is not caused to descend to the home position HP but to enter a standby state above the home position HP, thereby shortening the time required for the lower stack tray 18*b* to move to the discharge position, i.e., the tray switching time when a sheet is to be discharged to the lower stack tray 18*b* again.

In FIG. 14, reference numeral 1 denotes a first lower limit sensor that serves as a lower-limit detecting means and detects the lower limit position of the stack tray 18*a* and 18*b*, which descend as the number of stacked sheets increases. The upper surface sensor 5 is disposed below the first lower limit sensor 1. Reference numeral 29 denotes a second lower limit sensor that serves as a lower-limit-of-lower-tray detecting means and detects the lower limit position of the lower stack tray 18*b*.

By providing the upper surface sensor 5 below the first lower limit sensor 1 that limits the descending movement of the upper and lower stack trays 18*a* and 18*b*, when sheets are stacked on the upper stack tray 18*a*, the upper stack tray 18*a* is prevented from colliding the lower stack tray 18*b* or the sheets on the lower stack tray 18*b*, the lower stack tray 18*b* being at a position (referred to as upper standby position hereinafter, where the upper surface sensor 5 detects the floor on which the sheets are placed or the top surface of the stack of sheets on the floor.

A process for discharging sheets of a sheet processing unit 119 will be described.

A description is given of a case in which, for example, sheets are stacked on the lower stack tray 18*b* after a sheet is discharged to the upper stack tray 18*a*. In order to stack sheets on the upper stack tray 18*a*, the controller 860 causes stacker motors 209*a* and 209*b* to rotate in a reverse direction so that the lower stack tray 18*b* descends to an upper standby position, i.e., a position where the upper surface sensor 5 detects the floor of the lower stack tray 18*b* on which the sheets are to be placed, and causes the upper stack tray 18*a* to move to the discharge position below the outlet 36.

When a predetermined number of sheets has been discharged to the upper stack tray 18*a* that has moved to the discharge position, or when the upper stack tray 18*a* becomes full of sheets, the stacker motor 209*a* is rotated in a forward direction to move the upper stack tray 18*a* to move to the retracted position above the outlet 36.

In switching trays as described above, in order to prevent the sheets on the upper stack tray 18*a* from moving backward, the shutter member (not shown) is caused to ascend to close the outlet 36 and thereafter the upper stack tray 18*a* is caused to ascend.

As shown in FIG. 4, the lower stack tray 18*b* is caused to ascend until the sheet sensor 3 detects the floor of the lower stack tray 18*b* on which sheets are to be placed or the top surface of the sheets on floor of the lower stack tray 18*b*, thereby moving the lower stack tray 18*b* to the discharge position. The shutter member (not shown) is then caused to descend to open the outlet 36. Thereafter, the sheets are discharged to the lower stack tray 18*b*.

The sheets stacked on the lower stack tray 18*b* will not increase to a height higher than the outlet 36. When sheets are stacked on the lower stack tray 18*b*, the upper stack tray 18*a* that has moved to the retracted position above the outlet 36 takes up a position above the upper surface of the stack of sheets on the lower stack tray 18*b*.

After a number of sheets are stacked on the lower stack tray 18*b*, if subsequent sheets are to be stacked on the upper stack tray 18*a* again, then the lower stack tray 18*b* is caused to descend to a position at which the upper surface sensor 5 detects the top surface of the stack of sheets, and then to stop to enter a standby state. In the second embodiment, the lower stack tray 18*b* is caused to descend until the upper surface sensor 5 detects the lower stack tray 18*b*, then the lower stack tray 18*b* is further moved to a lower position where the upper surface sensor 5 can no longer detect the lower stack tray 18*b*. Then, the lower stack tray 18*b* is caused to ascend to a position where the upper surface sensor 5 can detect the lower stack tray 18*b* again.

Figure 15:
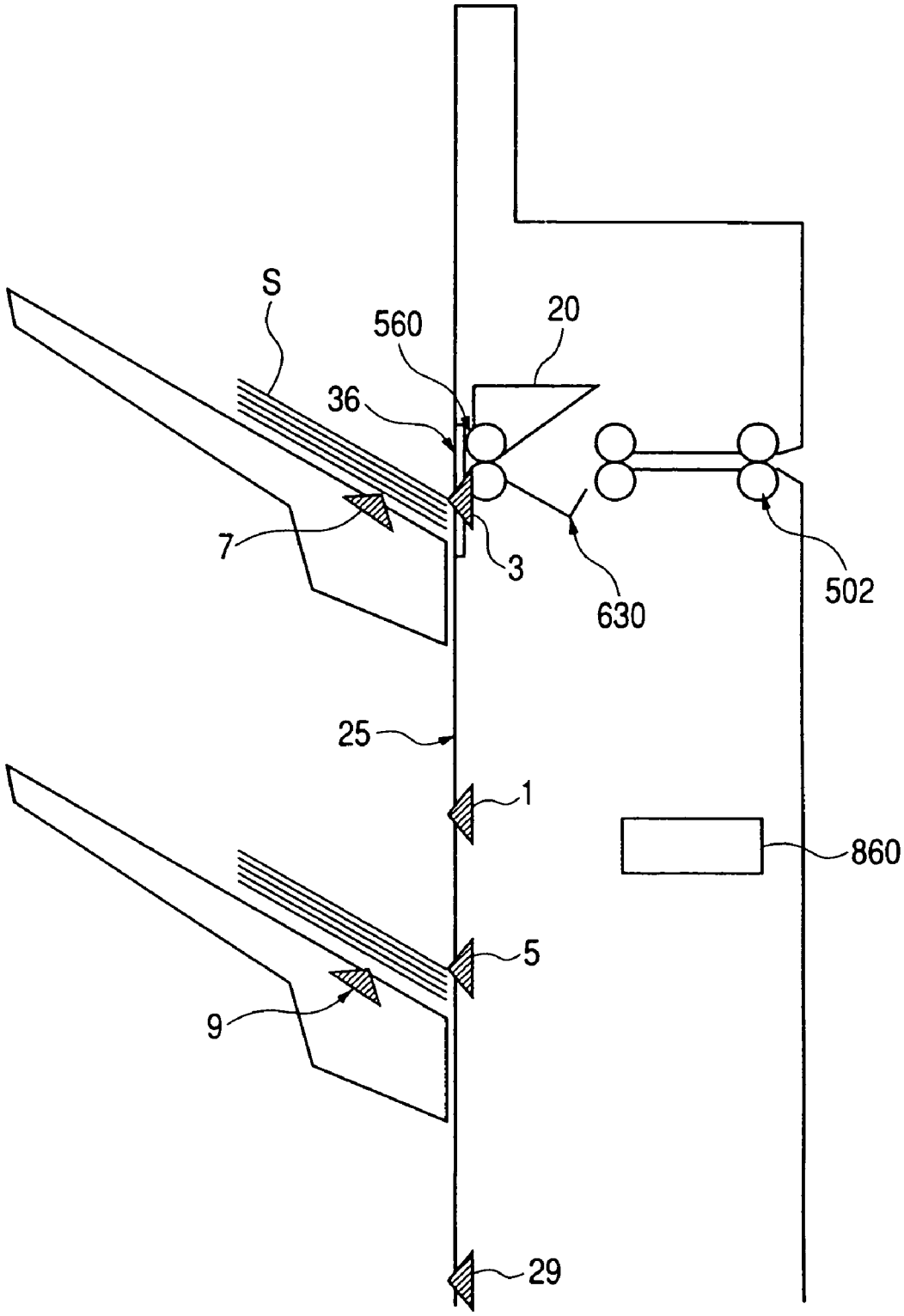
FIG. 15 illustrates an operation for selecting a stack tray of the sheet post-handling apparatus to which the sheets are to be discharged, switching from a lower stack tray to an upper stack tray.

As shown in FIG. 15, after the upper stack tray 18*a* is moved to a position below the outlet 36, the sheets S are discharged onto the upper stack tray 18*b*. When a tray switching operation is performed, in order to prevent the sheets S on the upper stack tray 18*a* from moving backward, the shutter member (not shown) is caused to ascend to close the outlet 36 and subsequently the upper stack tray 18*a* is caused to descend. Thereafter, the shutter member is caused to descend to open the outlet 36.

Thereafter, when the sheets S are discharged in sequence onto the upper stack tray 18*a*, the upper stack tray 18*a* gradually descends and eventually the lower end of the upper stack tray 18*a* is detected by the lower limit sensor 1.

Figure 16:
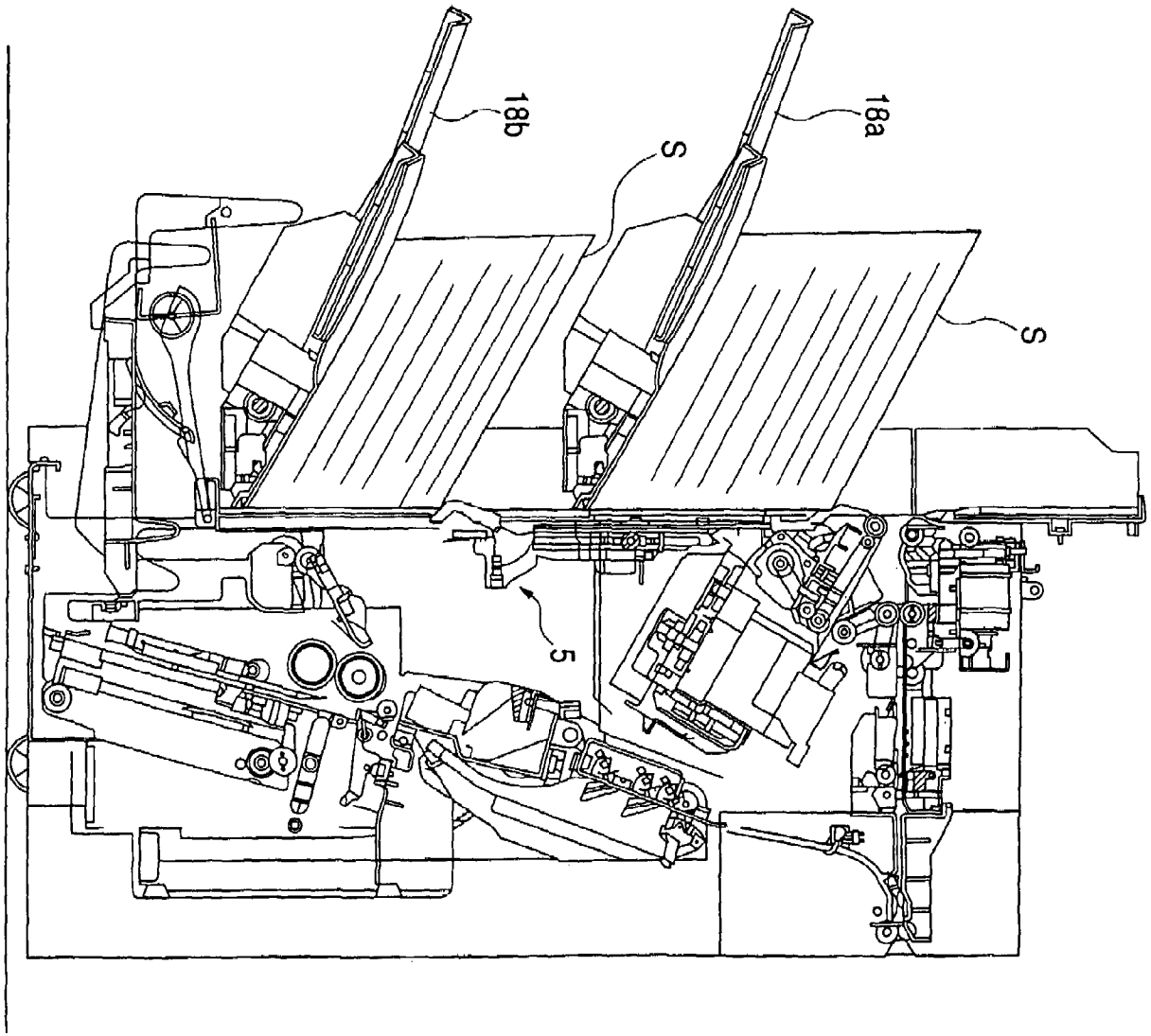
FIG. 16 illustrates another operation for selecting a stack tray of the sheet post-handling apparatus to which the sheets are to be discharged, switching from the upper stack tray to the lower stack tray.

After the lower limit sensor 1 detects the upper stack tray 18*a*, the upper stack tray 18*a* moves to the retracted position and the lower stack tray 18*b* ascends from a position in FIG. 16 to the discharge position.

When sheets are stacked on the upper stack tray 18*a*, the lower stack tray 18*b* is in a standby state at the upper standby position. Thus, the lower stack tray 18*b* can move so that the top surface of the stacked sheets on the lower stack tray 18*b* reaches the discharge position in a short time. Then, the sheets are stacked onto the lower stack tray 18*b*.

Figure 17:
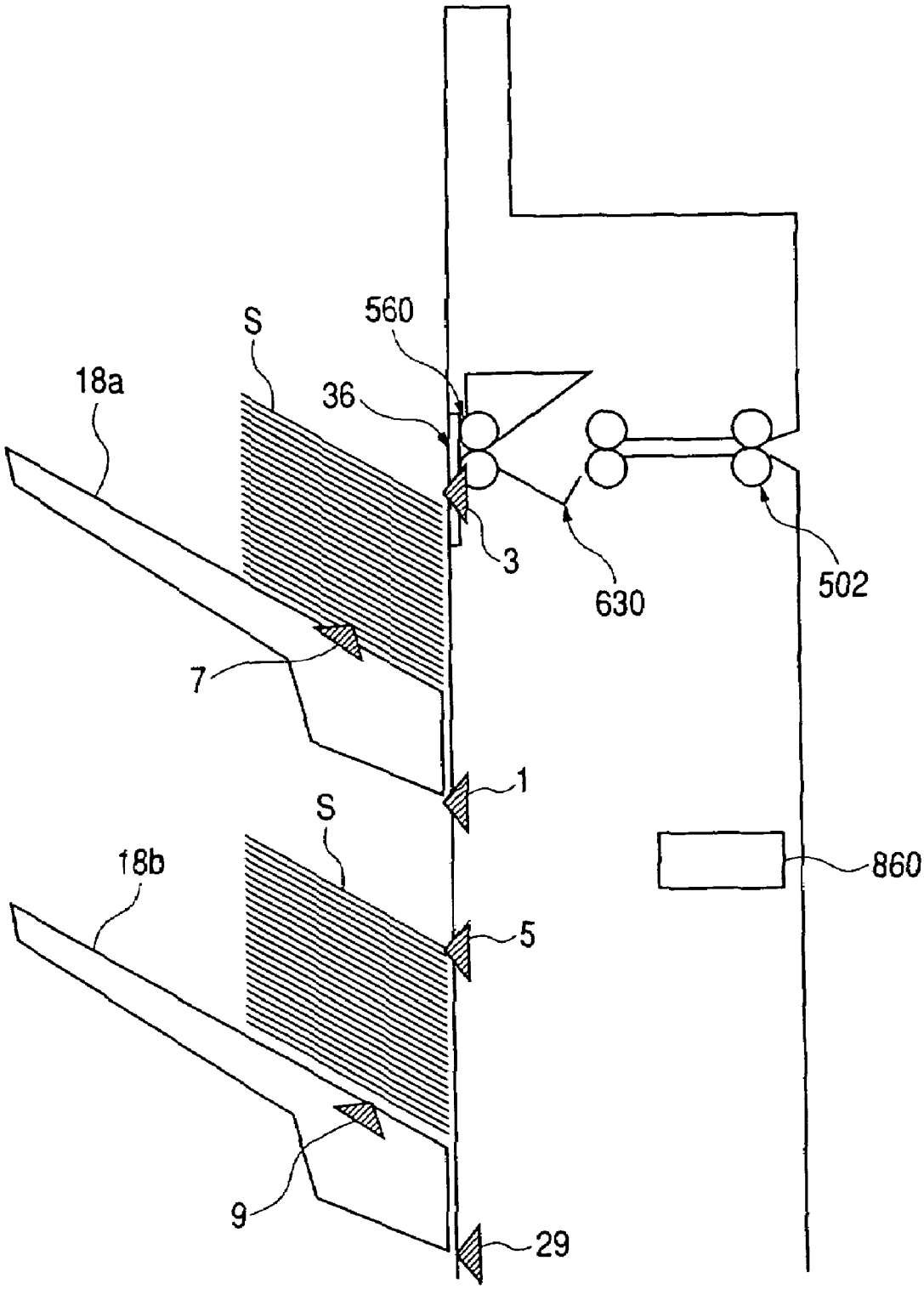
FIG. 17 illustrates when the upper and lower stack trays are full of sheets.

FIG. 17 illustrates the upper stack tray 18*a* and the lower stack tray 18*b* that are full of sheets after the aforementioned tray switching operation is repeated. After the sheets S are removed from the upper and lower stack trays 18*a* and 18*b* that are full of sheets, the controller 860 causes the upper stack tray 18*b* to ascend to the discharge position in response to a signal output from a sheet sensor 7 provided on the upper stack tray 18*a*.

The controller 860 causes the lower stack tray 18*b* to ascend to the upper standby position in response to a signal from a sheet sensor 9 provided on the lower stack tray 18*b*. In this manner, the sheets continue to be discharged onto the upper and lower stack trays 18*a* and 18*b*.

In the second embodiment, as shown in FIG. 3, the distance L2 between the upper surface sensor 5 and a second lower limit sensor 29 is selected to be equal to or longer than the distance L1 between the first lower limit sensor 1 and the sheet sensor 3.

Thus, the upper surface sensor 5 can detect the top surface of the stack of sheets S on the lower stack tray 18*b* until the descending lower stack tray 18*b* is descends by the first lower limit sensor 1 with increase of the stack of sheets S and then by the second lower limit sensor 29. Thus, the second lower limit sensor 29 can reliably detect the top surface of the sheets on the lower stack tray 18*b*.

Unless the lower stack tray is full of sheets, when the sheets S are to be discharged onto the upper stack tray 18*a*, the lower stack tray 18*b* is caused to enter at a position above the home position HP, that is, the lower limit of the lower stack tray 18*b*. This saves the time required for switching between the upper and lower stack trays 18*a* and 18*b* and improves the productivity.

By providing the upper surface sensor 5 below the first lower limit sensor 1 and above the home position HP, the upper stack tray 18*a* that is descending is prevented from colliding the lower stack tray 18*b* in the standby state or the sheets on the lower stack tray 18*b*. Thus, the upper and lower stack trays 18*a* and 18*b* are prevented from being damaged and the sheets S on the stack trays are prevented from being poorly aligned.

The embodiment has been described with respect to a sheet handling apparatus in which a process for binding sheets is performed and an image forming apparatus that is provided with such a sheet handling apparatus. It goes without saying that the present invention is not limited to this case but may be applicable to any apparatus in which a process for punching sheets is performed. Also, the embodiment has been described with respect to a sheet processing apparatus having two trays but the invention can also be applicable to a sheet processing apparatus having more than two trays.

According to the second embodiment, when sheets are stacked onto the first stack tray, the second stack tray below the first stack tray is set in a standby state above the initial position. Therefore, the tray switching time can be shortened. Also, the second stack tray is in a standby state at a position below the lower limit detecting means which detects that the first and second stack trays have reached their lower limit positions. Thus, the descending first stack tray will not collide the floor of the second tray in a standby state on which the sheets are placed or the top surface of the sheets on floor of the second tray, so that the stack trays are prevented from being damaged and the sheets on the stack trays are prevented from being poorly aligned.

What is claimed is:

1. A sheet stacking apparatus, comprising:

a stack tray onto which sheets discharged from an outlet are stacked;

a driving device which drives the stack tray to ascend and descend;

a sheet surface detecting device which detects a top surface of the sheets stacked on the stack tray at a stacking position at which the sheets discharged from the outlet are stacked;

a height controlling portion which controls said driving device to move the stack tray to the stacking position in such a way that the top surface detected by said sheet surface detecting device maintains a constant height; and a time measuring portion which measures time;

a standby controlling portion which causes the stack tray to stop when said time measuring portion detects the lapse, from a start of movement, of a time period for a moving operation that is calculated based on a predetermined distance of movement of the stack tray and a moving speed where the stack tray moves the predetermined distance.

2. The sheet stacking apparatus according to claim 1, further comprising:

a standby position detecting unit which detects the sheet stacked on the stack tray after the elapse of the time period for the moving operation, said standby position detecting unit detecting the top surface of the sheets stacked on the stack tray according to a change in the detection result; and an ascending movement controlling portion which controls so as to ascend until the result of detection by said standby position detecting unit again changes, if the result of detection by said standby position detecting unit already changes when the stack tray stops the descending movement.

3. The sheet stacking apparatus according to claim 2, wherein if said ascending movement controlling portion does not complete ascending movement of the stack tray within a predetermined time period for ascending movement, the ascending movement of the stack tray is controlled to be terminated.

4. An image forming apparatus, comprising:

an image forming unit which forms an image on a sheet; and a sheet stacking apparatus, said sheet stacking apparatus comprising:

a stack tray onto which sheets discharged from an outlet are stacked;

a driving device which drives said stack tray to ascend and descend;

a sheet surface detecting device which detects a top surface of the sheets stacked on the stack tray at a stacking position at which the sheets discharged from the outlet are stacked;

a height controlling portion which controls said driving device to move the stack tray to the stacking position in such a way that the top surface detected by said sheet surface detecting device maintains a constant height;

a time measuring portion which measures time;

a standby controlling portion which causes the stack tray to stop when said time measuring portion detects the lapse, from a start of movement, of a time period for a moving operation that is calculated based on a predetermined distance of movement of the stack tray and a moving speed where the stack tray moves the predetermined distance.

* * * * *

UNITED STATES PATENT AND TRADEMARK OFFICE

CERTIFICATE OF CORRECTION

PATENT NO. : 7,377,511 B2
APPLICATION NO. : 11/452950
DATED : May 27, 2008
INVENTOR(S) : Watanabe et al.

It is certified that error appears in the above-identified patent and that said Letters Patent is hereby corrected as shown below:

ON THE TITLE PAGE:
At Item (57), Abstract, Line 2, “form” should read --from--.
At Item (57), Abstract, Line 5, “staking” should read --stacking--.

COLUMN 1:
Line 37, “occur” should read --occurs--.

COLUMN 5:
Line 13, “is” should be deleted.
Line 17, “are inverted each other” should read --are each inverted--.
Line 26, “that” should be deleted.

COLUMN 6:
Line 22, “stapler” should read --staplers--.
Line 23, “functions” should read --function--.

COLUMN 8:
Line 30, “sensors,” should read --sensor,--.
Line 47, “that” should be deleted.

COLUMN 9:
Line 8, “of in” should read --of--.

COLUMN 12:
Line 34, “sheet” should read --sheets--.
Line 48, “sheet” should read --sheets--.

COLUMN 13:
Line 66, “become” should read --becomes--.

COLUMN 14:
Line 33, “are omitted their description.” should read --their description is omitted.--.

COLUMN 15:
Line 50, “colliding” should read --colliding with--.
Line 53, “hereinafter,” should read --hereinafter),--.

UNITED STATES PATENT AND TRADEMARK OFFICE

CERTIFICATE OF CORRECTION

PATENT NO. : 7,377,511 B2
APPLICATION NO. : 11/452950
DATED : May 27, 2008
INVENTOR(S) : Watanabe et al.

It is certified that error appears in the above-identified patent and that said Letters Patent is hereby corrected as shown below:

COLUMN 17:
Line 16, “is” should be deleted.
Line 31, “colliding” should read --colliding with--.
Line 38, “that” should be deleted.

COLUMN 18:
Line 9, “and” should be deleted.
Line 10, “time;” should read --time; and--.
Line 55, “time;” should read --time; and--.

Signed and Sealed this

Twenty-fifth Day of November, 2008

JON W. DUDAS
*Director of the United States Patent and Trademark Office*